US007645520B2

(12) United States Patent
Miyamoto

(10) Patent No.: US 7,645,520 B2
(45) Date of Patent: Jan. 12, 2010

(54) ENDLESS BELT AND PRODUCTION METHOD THEREOF, INTERMEDIATE TRANSFER BELT, AND IMAGE FORMING APPARATUS

(75) Inventor: Tsuyoshi Miyamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 400 days.

(21) Appl. No.: 11/812,503

(22) Filed: Jun. 19, 2007

(65) Prior Publication Data

US 2008/0138120 A1 Jun. 12, 2008

(30) Foreign Application Priority Data

Dec. 12, 2006 (JP) ..... 2006-334225

(51) Int. Cl.
*G03G 15/16* (2006.01)

(52) U.S. Cl. ..... 428/473.5; 264/232; 264/233; 264/234; 264/236; 264/294; 264/331.16; 399/162; 399/297; 399/302; 399/308; 399/313; 427/340; 427/341; 427/385.5; 427/388.1

(58) Field of Classification Search ..... 399/162, 399/297, 302, 308, 313; 264/232, 233, 234, 264/236, 294, 331.16; 427/340, 341, 385.5, 427/388.1; 428/473.5
See application file for complete search history.

(56) References Cited

FOREIGN PATENT DOCUMENTS

| | | |
|---|---|---|
| JP | A 05-200904 | 8/1993 |
| JP | A 06-149083 | 5/1994 |
| JP | A 06-228335 | 8/1994 |
| JP | A 08-259709 | 10/1996 |
| JP | A 11-235765 | 8/1999 |
| JP | A 2001-022189 | 1/2001 |
| JP | A 2002-292656 | 10/2002 |
| JP | A 2004-004393 | 1/2004 |
| JP | A 2004-101548 | 4/2004 |

*Primary Examiner*—D. S Nakarani
(74) *Attorney, Agent, or Firm*—Oliff & Berridge, PLC

(57) ABSTRACT

The present invention provides an endless belt containing a conductive agent and a polyimide resin whose imidation ratio at an outer circumference surface of the belt and that at an inner circumference surface of the belt are mutually different, and a method of producing the endless belt, an intermediate transfer belt having the endless belt, and an image forming apparatus having the endless belt.

7 Claims, 5 Drawing Sheets

ENDLESS BELT AND PRODUCTION METHOD THEREOF, INTERMEDIATE TRANSFER BELT, AND IMAGE FORMING APPARATUS

CROSS-REFERENCE TO RELATED APPLICATIONS

This application is based on and claims priority under 35 USC 119 from Japanese Patent Application No. 2006-334225 filed in Dec. 12, 2006.

BACKGROUND

1. Technical Field

The invention relates to an endless belt and a method of producing the same, an intermediate transfer belt, and an image forming apparatus.

2. Related Art

In an electrophotography apparatus (image forming apparatus), first, charges are formed on a photoreceptor using an electrically conductive material, modulated image signals are converted to an electrostatic latent image by laser beam and the like, then, the electrostatic latent image is developed with charged toner to give a toner image. Then, this toner image is transferred onto a recording medium directly or via an intermediate transfer body, obtaining an image.

In an image forming apparatus adopting a method of primarily transferring a toner image on a photoreceptor onto an intermediate transfer body, then, secondarily transferring the toner image on the intermediate transfer body onto a recording medium such as paper and the like, what is called an intermediate transfer mode, an intermediate transfer belt is used as the intermediate transfer body.

For the purpose of imparting conductivity to a polyimide material, carbon black particles having conductivity are dispersed in a polyimide resin. It is well known that variation in resistance of a polyimide endless belt owing to voltage may be suppressed by enhancing dispersibility of carbon black.

When such a polyimide endless belt containing a dispersed conductive material is used as the intermediate transfer body, a high resistant layer is provided, as an effective means, on a belt-shaped intermediate surface layer for conducting multicolor printing of high image quality.

SUMMARY

According to an aspect of the invention, there is provided an endless belt comprising a conductive agent and a polyimide resin whose imidation ratio at an outer circumference surface of the belt and that at an inner circumference surface of the belt are mutually different.

BRIEF DESCRIPTION OF THE DRAWINGS

Exemplary embodiments of the present invention will be described in detail based on the following figures, wherein.

DETAILED DESCRIPTION

Exemplary embodiments of the invention will be illustrated in detail referring to drawings, below. Members having common functions and actions are endowed with the same marks throughout all figures, and duplicated descriptions are omitted in some cases.

First Exemplary Embodiment

Figure 1:
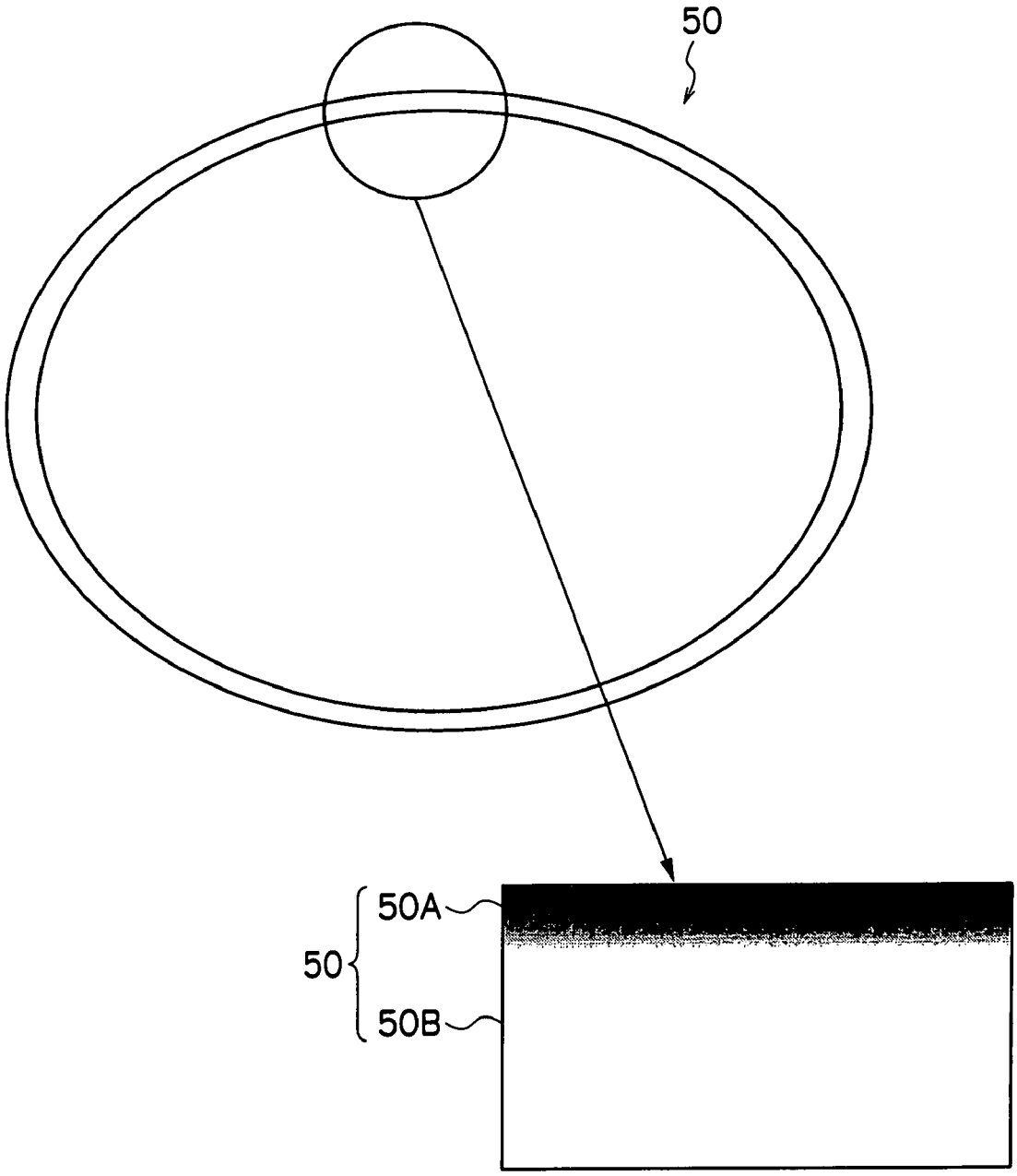
FIG. 1 is a schematic constitutional view showing an endless belt according to a first exemplary embodiment.
Figure 2:
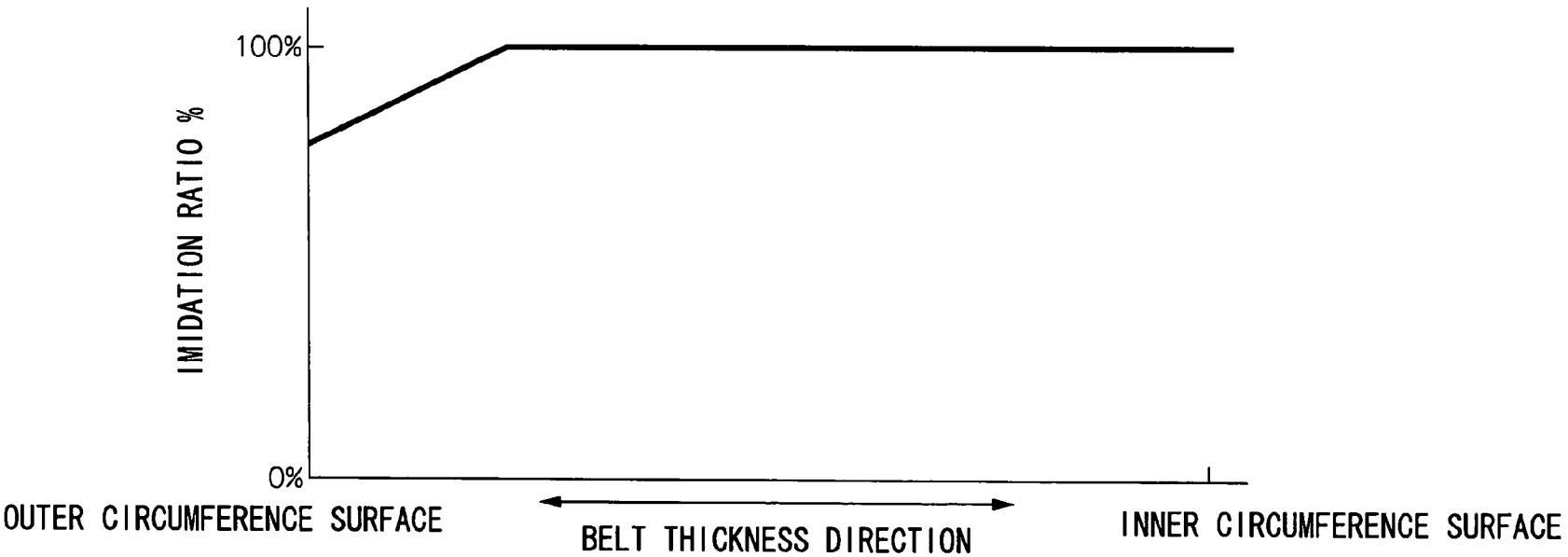
FIG. 2 is a conceptual view showing distribution of imidation ratio of a polyimide resin toward thickness direction in an endless belt according to the first exemplary embodiment.

FIG. 1 is a schematic constitutional view showing an endless belt according to a first exemplary embodiment. FIG. 2 is a conceptual view showing distribution of imidation ratio of a polyimide resin toward thickness direction in an endless belt according to the first exemplary embodiment.

An endless belt 50 according to the first exemplary embodiment is constituted of a single polyimide resin layer containing a conductive agent as shown in FIG. 1. The outer circumference surface and the inner circumference surface of the endless belt 50 have mutually different surface resistivity together with mutually different imidation ratios of a polyimide resin. In this exemplary embodiment, the imidation ratio of a polyimide resin at the outer circumference surface is lower than that at the inner circumference surface. Additionally, the surface resistivity at the outer circumference surface is lower than that at the inner circumference surface.

The endless belt 50 according to this exemplary embodiment has, for example, a region 50A in which the imidation ratio increases continuously from the outer circumference surface side toward the inner circumference surface side of the belt in the range of 50% or less of the thickness, and a region 50B in which the imidation ratio is constant from the region 50A toward the inner circumference surface, thereafter. Specifically, the imidation ratio of a polyimide resin increases continuously from the outer circumference surface side toward the inner circumference surface side of the belt and becomes constant thereafter as shown for example in FIG. 2.

Additionally, a molecular structure of a tetracarboxylic acid residue and a diamine compound residue constituting the polyimide resin at the outer circumference surface and that at the inner circumference surface are mutually the same, and a composition ratio of the tetracarboxylic acid residue to the diamine compound residue constituting the polyimide resin at the outer circumference surface and that at the inner circumference surface are mutually the same.

That is, the endless belt 50 according to this exemplary embodiment has a single layer structure and has no clear boundary face even if the imidation ratios and surface resistivity of a polyimide resin at the outer circumference surface and that at the inner circumference surface are mutually different.

The features that "molecular structures of a tetracarboxylic acid residue and a diamine compound residue constituting a polyimide resin are the same" and that "a composition ratio of the tetracarboxylic acid residue to the diamine compound residue is the same" may be investigated as described below.

From this belt, a specific portion is cut out or polished, to manufacture a test specimen. This test specimen is heated and hydrolyzed in a strong base aqueous solution in an amount of 10-times or more. Here, a strong base such as sodium hydroxide, potassium hydroxide, calcium hydroxide and the like is dissolved in water to prepare the basic aqueous solution to be used. The concentration of this strong base aqueous solution is appropriately selected in the range of 5% by weight or more and 30% by weight or less.

After hydrolysis, the polyimide resin is decomposed into polyamic acid, further into a diamine compound and tetracarboxylic acid. From the hydrolysis liquid, tetracarboxylic acid and diamine compound are extracted in a liquid phase using chloroform. The extraction liquid is subjected to qualitative/quantitative analyses by liquid chromatography, and solution peaks of the corresponding tetracarboxylic acid and diamine compound are used as standards and compared, thus, the structures of the diamine compound residue and the tetracarboxylic acid residue and the content ratios of the diamine compound residue to the tetracarboxylic acid residue contained in the polyimide resin may be determined.

"Tetracarboxylic acid residue" denotes a tetravalent organic group (for example, corresponding to $R_1$, $R_3$ and $R_5$ in the formulae (1) and (2) described later) connected by four carboxylic acids (or, connecting groups formed by them). On the other hand, "diamine compound residue" denotes a divalent organic group (for example, corresponding to $R_2$ and $R_6$ in the formulae (1) and (2) described later) connected to "N," or "NH".

The imidation ratio of a polyimide resin at the outer circumference surface is desirably 50% or more and 95% or less, more desirably 60% or more and 90% or less, further desirably 70% or more and 85% or less. On the other hand, the imidation ratio of a polyimide resin at the inner circumference surface is desirably 60% or more and 100% or less, more desirably 70% or more and 100% or less, further desirably 90% or more and 100% or less.

The difference between the imidation ratio of the polyimide resin at the outer circumference surface and the imidation ratio of the polyimide resin at the inner circumference surface is desirably 5% or more and 20% or less, more desirably 10% or more and 20% or less, further desirably 15% or more and 20% or less.

The region in which the imidation ratio of a polyimide resin changes from the outer circumference surface toward the inner circumference surface is desirably a region of 50% or less of the thickness from the outer circumference surface, more desirably 40% or less of the thickness, further desirably 30% or less of the thickness. Specifically, for example, the region in which the imidation ratio of a polyimide resin changes is desirably a depth of 50 μm or less toward the thickness direction from the outer circumference surface, more desirably a depth of 40 μm or less, further desirably a depth of 30 μm or less, hypothesizing the thickness is 100 μm.

On the other hand, the surface resistivity at the outer circumference surface and the surface resistivity at the inner circumference surface differ mutually, and the common logarithm value thereof is desirably 9 (log Ω) or more and 13 (log Ω) or less, more desirably 11.5 (log Ω) or more and 12.5 (log Ω) or less, further desirably 10 (log Ω) or more and 12 (log Ω) or less.

The difference between the surface resistivity at the outer circumference surface and the surface resistivity at the inner circumference surface is, in terms of common logarithm value, desirably larger than 0.5 (log Ω), more desirably larger than 1.0 (log Ω). The upper limit of this difference is desirably 4.0 (log Ω) or less.

The method of producing the endless belt 50 according to this exemplary embodiment will be illustrated below.

The endless belt 50 according to this exemplary embodiment may be produced, for example, as described below. The endless belt 50 may be produced via a process of applying a polyimide precursor on a metal mold to form a coating film, a process of drying the coating film, and then, calcining the film to form a polyimide resin film, and a process of performing a hydrolysis treatment on one surface of the polyimide resin film.

First, the polyimide precursor will be described. As the polyimide precursor, for example, polyamic acid compositions described below are mentioned. The polyamic acid compositions have, for example, a constitution containing a polymer containing a polyamic acid structure, a coating solvent, and a tertiary amine as a catalyst. If necessary, additives such as a carboxylic anhydride, conductive agent, dispersing agent and the like may also be contained.

The compositions of polyimide resins (its precursor) are only examples, and the precursor is not limited to them. For example, polyimide resin analogous materials may also be used. As the polyimide resin analogous material, polymer materials containing an imide skeleton in a polymer main chain structure may be used. Specific examples include polyamideimide resins obtained by copolymerizing trimellitic acid instead of tetracarboxylic acid, in a precursor composition described later, to allow a polymer main chain structure to have an amide group and an imide group together; polyimide-polyamic acid copolymers containing an amic acid residue remaining by partially performing an imidation reaction by controlling the reaction condition for polyamic acid. When a polyamideimide resin is used, for example, trimellitic acid derivatives such as trimellitic anhydride and the like are used as raw materials instead of tetracarboxylic dianhydride described later. On the other hand, in the case of a polyimide-polyamic acid copolymer, tetracarboxylic dianhydride described later is used.

The polyamic acid composition will be illustrated further in detail below.

(Polymer Containing Polyamic Acid Structure)

The polymer containing a polyamic acid structure is a polymer which may be a polyimide precursor, and includes polyamic acids and polyamic acid-polyimide copolymers.

The polyamic acid includes suitably a polyamic acid of the following formula (1). The polyamic acid-polyimide copolymer includes suitably a polyamic acid-polyimide copolymer of the following formula (2).

Formula (1)

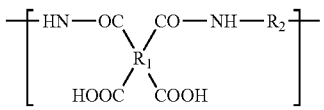

Formula (2)

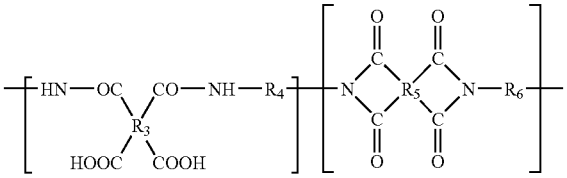

In the formula (1), $R_1$ represents a tetravalent organic group and $R_2$ represents a divalent organic group. While, in the formula (2), $R_3$ represents a tetravalent organic group, $R_4$ represents a divalent organic group, $R_5$ represents a tetravalent organic group and $R_6$ represents a divalent organic group.

Here, divalent organic groups $R_2$, $R_4$ and $R_6$ represent residual structures obtained by removing two amino groups from the corresponding diamine compounds. Tetravalent organic groups $R_1$, $R_3$ and $R_5$ represent residues obtained by removing four carbonyl groups from the corresponding tetracarboxylic acid compounds.

The polyamic acid and polyamic acid-polyimide copolymer will illustrate further in detail below.

The polyamic acid is obtained by polymerizing tetracarboxylic dianhydride and diamine compound of equimolar amount in an organic polar solvent. The polyimide-polyamic acid copolymer is synthesized by polymerizing a polyamic acid, and then, performing partial imidation reaction.

—Tetracarboxylic Dianhydride—

The tetracarboxylic dianhydride which may be used in production of a polyamic acid is not particularly restricted, and any of aromatic and aliphatic compounds may be used.

Examples of the aromatic tetracarboxylic dianhydride include pyromellitic dianhydride, 3,3',4,4'-benzophenonetetracarboxylic dianhydride, 3,3',4,4'-biphenylsulfonetetracarboxylic dianhydride, 1,4,5,8-naphthalenetetracarboxylic dianhydride, 2,3,6,7-naphthalenetetracarboxylic dianhydride, 3,3',4,4'-biphenyl ether tetracarboxylic dianhydride, 3,3',4,4'-dimethyldiphenylsilanetetracarboxylic dianhydride, 3,3',4,4'-tetraphenylsilanetetracarboxylic dianhydride, 1,2,3,4-furantetracarboxylic dianhydride, 4,4'-bis(3,4-dicarboxyphenoxy)diphenyl sulfide dianhydride, 4,4'-bis(3,4-dicarboxyphenoxy)diphenyl sulfone dianhydride, 4,4'-bis(3,4-dicarboxyphenoxy)diphenylpropane dianhydride, 3,3',4,4'-perfluoroisopropylidenediphthalic dianhydride, 3,3',4,4'-biphenyltetracarboxylic dianhydride, bis(phthalic) phenylphosphine oxide dianhydride, p-phenylene-bis (triphenylphthalic) dianhydride, m-phenylene-bis (triphenylphthalic) dianhydride, bis(triphenylphthalic)-4,4'-diphenyl ether dianhydride, bis(triphenylphthalic)-4,4'-diphenylmethane dianhydride and the like.

The aliphatic tetracarboxylic dianhydride includes aliphatic or alicyclic tetracarboxylic dianhydrides such as butanetetracarboxylic dianhydride, 1,2,3,4-cyclobutanetetracarboxylic dianhydride, 1,3-dimethyl-1,2,3,4-cyclobutanetetracarboxylic dianhydride, 1,2,3,4-cyclopentanetetracarboxylic dianhydride, 2,3,5-tricarboxycyclopentylacetic dianhydride, 3,5,6-tricarboxynorbornane-2-acetic dianhydride, 2,3,4,5-tetrahydrofurantetracarboxylic dianhydride, 5-(2,5-dioxotetrahydrofural)-3-methyl-3-cyclohexene-1,2-dicarboxylic dianhydride, bicyclo[2,2,2]-oct-7-ene-2,3,5,6-tetracarboxylic dianhydride and the like; and aliphatic tetracarboxylic dianhydrides having an aromatic ring such as 1,3,3a,4,5,9b-hexahydro-2,5-dioxo-3-furanyl-naphtho[1,2-c]furan-1,3-dione, 1,3,3a,4,5,9b-hexahydro-5-methyl-5-(tetrahydro-2,5-dioxo-3-furanyl)-naphtho[1,2-c]furan-1,3-dione, 1,3,3a,4,5,9b-hexahydro-8-methyl-5-(tetrahydro-2,5-dioxo-3-furanyl)-naphtho[1,2-c]furan-1,3-dione, and the like.

The tetracarboxylic dianhydride is preferably an aromatic tetracarboxylic dianhydride, and further, pyromellitic dianhydride, 3,3',4,4'-benzophenonetetracarboxylic dianhydride and 3,3',4,4'-biphenylsulfonetetracarboxylic dianhydride are suitably used.

These tetracarboxylic dianhydrides may be used singly or in combination of two or more.

—Diamine Compound—

The diamine compound which may be used in production of a polyamic acid is not particularly restricted providing it is a diamine compound having two amino groups in the molecule structure.

Examples thereof include aromatic diamines such as p-phenylenediamine, m-phenylenediamine, 4,4'-diaminodiphenylmethane, 4,4'-diaminodiphenylethane, 4,4'-diaminodiphenyl ether, 4,4'-diaminodiphenyl sulfide, 4,4'-diaminodiphenyl sulfone, 1,5-diaminonaphthalene, 3,3-dimethyl-4,4'-diaminobiphenyl, 5-amino-1-(4'-aminophenyl)-1,3,3-trimethylindan, 6-amino-1-(4'-aminophenyl)-1,3,3-trimethylindan, 4,4'-diaminobenzanilide, 3,5-diamino-3'-trifluoromethylbenzanilide, 3,5-diamino-4'-trifluoromethylbenzanilide, 3,4'-diaminodiphenyl ether, 2,7-diaminofluorene, 2,2-bis(4-aminophenyl) hexafluoropropane, 4,4'-methylene-bis(2-chloroaniline), 2,2',5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy)phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenyleneisopropylidene) bisaniline, 4,4'-(m-phenyleneisopropylidene)bisaniline, 2,2'-bis[4-(4-amino-2-trifluoromethylphenoxy)phenyl] hexafluoropropane, 4,4'-bis[4-(4-amino-2-trifluoromethyl) phenoxy]-octafluorobiphenyl; aromatic diamines having two amino groups connected to an aromatic ring and having a hetero atom other than a nitrogen atom of the amino group, such as diaminotetraphenylthiophene; aliphatic diamines and alicyclic diamines such as 1,1-metaxylylenediamine, 1,3-propanediamine, tetramethylenediamine, pentamethylenediamine, octamethylenediamine, nonamethylenediamine, 4,4-diaminoheptamethylenediamine, 1,4-diaminocyclohexane, isophoronediamine, tetrahydrodicyclopentadienylenediamine, hexahydro-4,7-methanoindanylenedimethylenediamine, tricyclo[6,2,1,$0^{2,7}$]-undecylenedimethyldiamine, 4,4'-methylenebis(cyclohexylamine).

The diamine compound includes preferably p-phenylenediamine, 4,4'-diaminodiphenylmethane, 4,4'-diaminodiphenyl ether, 4,4'-diaminodiphenyl sulfide, and 4,4'-diaminodiphenyl sulfone.

These diamine compounds may be used singly or in combination of two or more.

—Combination of Tetracarboxylic Dianhydride and Diamine Compound—

As the polyamic acid, desirably, those containing an aromatic tetracarboxylic dianhydride and an aromatic diamine are preferable.

—Synthesis Solvent—

Examples of the organic polar solvent to be used in a reaction for producing this polyamic acid include sulfoxide solvents such as dimethyl sulfoxide, diethyl sulfoxide; formamide solvents such as N,N-dimethylformamide, N,N-diethylformamide; acetamide solvents such as N,N-dimethylacetamide, N,N-diethylacetamide; pyrrolidone solvents such as N-methyl-2-pyrrolidone, N-vinyl-2-pyrrolidone; phenol solvents such as phenol, o-, m- or p-cresol, xylenol, phenol halide, catechol; ether solvents such as tetrahydrofuran, dioxane, dioxolane; alcohol solvents such as methanol, ethanol, butanol; cellosolves such as butylcellosolve; or hexamethylphosphoramide, γ-butyrolactone and the like, and it is desirable that these solvents are used singly or in admixture, further, aromatic hydrocarbons such as xylene, toluene may also be used. The solvent is not particularly restricted providing it dissolves polyamic acids and polyamic acid-polyimide copolymers.

—Solid Content in Polymerizing Polyamic Acid—

The solid content of a polyamic acid solution is not particularly restricted, and for example, it is preferably 5% by weight or more and 50% by weight or less, further preferably 10% by weight or more and 30% by weight or less.

—Polyamic Acid Polymerization Temperature—

The reaction temperature in polymerizing a polyamic acid is, for example, 0° C. or higher and 80° C. or lower.

—Imidation Reaction—

The polyamic acid-polyimide copolymer is obtained by converting at least a part of a polyamic acid structure in a polyamic acid into an imide group by a dehydration cyclization reaction, by a method of heat treatment of the above-described polyamic acid to cause imidation, or a chemical imidation method of allowing a dehydrating agent and/or a catalyst to act.

The heating temperature in the method by heat treatment is, for example, usually 60° C. or higher and 200° C. or lower, desirably 100° C. or higher and 170° C. or lower.

On the other hand, in the chemical imidation method, a dehydrating agent and/or a catalyst is added into a polyamic acid solution and an imidation reaction is progressed chemically. The dehydrating agent is not particularly restricted providing it is a monovalent carboxylic anhydride. For example, one or more compounds selected from acid anhydrides such as acetic anhydride, propionic anhydride, trifluoroacetic anhydride, butanoic anhydride and oxalic anhydride may be used. The amount of the dehydrating agent to be added is preferably 0.01 mol or more and 2 mol or less based on 1 mol of repeating units in the polyamic acid.

As the catalyst, one or more compounds selected from pyridine, picoline, collidine, lutidine, quinoline, isoquinoline, tertiary amines such as triethylamine may be used, however, the catalyst is not limited to them. The amount of the catalyst to be added is preferably 0.01 mol or more and 2 mol or less based on 1 mol of a dehydrating agent to be used.

This chemical imidation reaction is carried out by adding a dehydrating agent and/or a catalyst into a polyamic acid solution and, if necessary, heating the solution. The reaction temperature of dehydration cyclization is usually 0° C. or higher and 180° C. or lower, desirably 60° C. or higher and 150° C. or lower.

Though not particularly restricted providing partial imidation is attained, the composition ratio of an imidated structure to an unreacted amic acid structure is preferably 0/100 (mol/mol) to 80/20 (mol/mol). When the composition ratio of an imide group to an amic acid group is over 80/20 (mol/mol), there is a possibility of insolubilization of a polyamic acid-polyimide copolymer.

Though the dehydrating agent and/or catalyst acted on a polyamic acid-polyimide copolymer may not be removed, these may be removed by the following method. As the method of removing the acted dehydrating agent and/or catalyst, heating under reduced pressure or reprecipitation method may be used. The heating under reduced pressure is carried out in vacuo at temperatures of 80° C. or higher and 120° C. or lower, to distill off a tertiary amine to be used as a catalyst, an unreacted dehydrating agent and a hydrolyzed carboxylic acid. The reprecipitation method is carried out by using a poor solvent which dissolves a catalyst, unreacted dehydrating agent and hydrolyzed carboxylic acid but does not dissolve a polyamic acid-polyimide copolymer, and adding reaction liquid into the poor solvent of large excess amount. The poor solvent is not particularly restricted and, water, alcohol solvents such as methanol and ethanol, ketone solvents such as acetone and methyl ethyl ketone, hydrocarbon solvents such as hexane, and the like, may be used. The polyamic acid-polyimide copolymer to be deposited is, after filtration and drying, dissolved again in a solvent such as γ-butyrolactone and N-methyl-2-pyrrolidone.

The solid content of the polymer containing a polyamic acid structure in the polyamic acid composition is preferably 10% by weight or more for obtaining thickness desirable as a belt material. This solid content is desirably 15% by weight or more, and its upper limit is 50% by weight.

(Coating Solvent)

Examples of the coating solvent include sulfoxide solvents such as dimethyl sulfoxide, diethyl sulfoxide; formamide solvents such as N,N-dimethylformamide, N,N-diethylformamide; acetamide solvents such as N,N-dimethylacetamide, N,N-diethylacetamide; pyrrolidone solvents such as N-methyl-2-pyrrolidone, N-vinyl-2-pyrrolidone; phenol solvents such as phenol, o-, m- or p-cresol, xylenol, phenol halide, catechol; ether solvents such as tetrahydrofuran, dioxane, dioxolane; alcohol solvents such as methanol, ethanol, butanol; cellosolves such as butylcellosolve; or hexamethylphosphoramide, γ-butyrolactone and the like, and it is desirable that these solvents are used singly or in admixture, further, aromatic hydrocarbons such as xylene, toluene may also be used. The solvent is not particularly restricted providing it dissolves polyamic acids and polyamic acid-polyimide copolymers.

The coating solvent may be used in previous polyamic acid synthesis as a synthesis solvent. The synthesis solvent may be substituted by the coating solvent after polyamic acid polymerization. Substitution of the solvent may be carried out by any one of a method of adding a predetermined amount of solvent to a polyamic acid solution to perform dilution, a method of, after reprecipitation of a polymer, performing redissolution of a polymer in a predetermined solvent, and a method of adjusting a composition by adding a predetermined solvent while gradually distilling the solvent off.

(Solid Content of Polyamic Acid Composition)

Though the solid content of a polyamic acid composition is not particularly restricted, a range for manifesting suitable viscosity is selected, depending on easiness of performing a coating process in producing a polyimide endless belt. The viscosity which is optimum for coating is, in general, desirably 1 Pa·s or more and 100 Pa·s or less, and the solid content giving such viscosity is desirably 10% by weight or more and 40% by weight or less based on 100 parts by weight of a coating solvent (for example, organic polar solvent).

(Tertiary Amine)

The tertiary amine acts as a catalyst for an imidation reaction, and for example, one or more compounds selected from pyridine, picoline, collidine, lutidine, quinoline, isoquinoline and triethylamine may be suitably used.

Regarding the content of the tertiary amine, the amine may be added, for example, in an amount of 0.1 part by weight or more and 30 parts by weight or less based on 100 parts by weight of resin components in a polyamic acid composition.

(Carboxylic Anhydride)

The carboxylic anhydride acts as a dehydrating agent in an imidation reaction, and promotes an imidation reaction. The carboxylic anhydride includes acetic anhydride, trifluoroacetic anhydride, propionic anhydride, butanoic anhydrides, oxalic anhydride and the like, and of them, acetic anhydride is suitable. These may be used singly or in combination of two or more.

The content of a carboxylic anhydride may be, for example, 0.1 parts by weight or more and 30 parts by weight or less based on 100 parts by weight of resin components in a polyamic acid composition.

(Conductive Agent)

As the conductive agent, powders (powders having a primary particle size of less than 10 μm are preferable, and powders having a primary particle size of 1 μm or less are further desirable) having conductivity (for example, volume resistivity is less than $10^7$ Ω·cm, applicable in the following descriptions) or semiconductivity (for example, volume resistivity is $10^7$ Ω·cm or more and $10^{13}$ Ω·cm or less, applicable in the following descriptions) may be used, and the conductive agent is not particularly restricted providing desired electric resistance is obtained, and examples thereof include carbon blacks such as Ketjen black, acetylene black; metals such as aluminum and nickel; metal oxide compounds such as tin oxide; potassium titanate, and the like. These may be used singly or in combination. Of them, acidic carbon black having pH of 5 or less may be desirably added.

As the conductive agent, ion conductive substances such as LiCl, and conductive polymers such as polyaniline, polypyrrole, polysulfone, polyacetylene may also be added. These may be used singly or in combination.

When a conductive polymer is used as the conductive agent, the conductive polymer to be contained is present, for example, in the form of dissolution and/or dispersion in an organic polar solvent. The particle size of the dispersed conductive polymer particle is desirably 10 μm or less, more desirably 5 μm or less, further desirably 1 μm or less.

Additionally, though the content of a conductive polymer in a polyamic acid component is not particularly restricted, the content of a conductive polymer is particularly desirably 1 part by weight or more and 40 parts by weight or less when the content of a polyamic acid resin is 100 parts by weight.

—Acidic Carbon Black—

The acidic carbon black may be produced by imparting a carboxyl group, quinone group, lactone group, hydroxyl group or the like to the surface by an oxidation treatment of carbon black. This oxidation treatment may be carried out by an air oxidation method of contacting with air under a high temperature (for example, 300° C. or higher and 800° C. or lower) atmosphere to cause a reaction, a method of reacting with a nitrogen oxide or ozone under ambient temperature (for example, 25° C., applicable in the following descriptions), a method of carrying out air oxidation at high temperatures (for example, 300° C. or higher and 800° C. or lower), and then, carrying out ozone oxidation at low temperatures (for example, 20° C. or higher and 200° C. or lower), and the like.

Specifically, acidic carbon black may be produced by, for example, a contact method. This contact method includes a channel method, gas black method and the like. Also, acidic carbon black may be produced by a furnace black method using a gas or oil as a raw material. If necessary, a liquid phase oxidation treatment with nitric acid and the like may be carried out, after performing these treatments.

Though acidic carbon black may be produced by a contact method, it is usually produced by a furnace method of sealed mode. In a furnace method, only carbon black of high pH and low volatile matter is usually produced, however, the above-mentioned liquid phase oxidation treatment may be performed on the carbon black to control pH. Thus, carbon black produced by a furnace method and of which pH is controlled to 5 or lower by a post process treatment may also be applied.

The pH value of acidic carbon black is, for example, 5.0 or less, and desirably 4.5 or less, more desirably 4.0 or less.

Here, an aqueous suspension of carbon black is prepared, and pH thereof is measured by a glass electrode. pH of acidic carbon black may be controlled by conditions such as treating temperature and treating time in an oxidation treatment process.

It is suitable that acidic carbon black contains volatile components in a proportion of, for example, 1% or more and 25% or less, desirably 2% or more and 20% or less, more desirably 3.5% or more and 15% or less. The proportion of the volatile component is a value determined according to the method described in JIS K6211 (1982).

Specific examples of acidic carbon black include "PRINTEX 150T" (pH 4.5, volatile content 10.0% by weight), "SPECIAL BLACK 350" (pH 3.5, volatile content 2.2% by weight), "SPECIAL BLACK 100" (pH 3.3, volatile content 2.2% by weight), "SPECIAL BLACK 250" (pH 3.1, volatile content 2.0% by weight), "SPECIAL BLACK 5" (pH 3.0, volatile content 15.0% by weight), "SPECIAL BLACK 4" (pH 3.0, volatile content 14.0% by weight), "SPECIAL BLACK 4A" (pH 3.0, volatile content 14.0% by weight), "SPECIAL BLACK 550" (pH 2.8, volatile content 2.5% by weight), "SPECIAL BLACK 6" (pH 2.5, volatile content 18.0% by weight), "COLOR BLACK FW200" (pH 2.5, volatile content 20.0% by weight), "COLOR BLACK FW2" (pH 2.5, volatile content 16.5% by weight) and "COLOR BLACK FW2V" (pH 2.5, volatile content 16.5% by weight) manufactured by Degussa Corporation, and "MONARCH 1000" (pH 2.5, volatile content 9.5% by weight), "MONARCH 1300" (pH 2.5, volatile content 9.5% by weight), "MONARCH 1400" (pH 2.5, volatile content 9.0% by weight), "MOGUL-L" (pH 2.5, volatile content 5.0% by weight) and "REGAL 400R" (pH 4.0, volatile content 3.5% by weight) manufactured by Cabot Corporation.

It is desirable that the content of the carbon black is 20 parts by weight or more and 40 parts by weight or less based on 100 parts by weight of a polyamic acid in a polyamic acid composition.

(Dispersing Agent)

As the dispersing agent, any kind of dispersing agents selected from those of low molecular weight/high molecular weight and cationic/anionic/nonionic agents may be used. As the dispersing agent, nonionic polymers are most desirably used.

—Nonionic Polymer—

The nonionic polymer includes poly(N-vinyl-2-pyrrolidone), poly(N,N'-diethyl acrylazide), poly(N-vinylformamide), poly(N-vinylacetamide), poly(N-vinylphthalamide), poly(N-vinylsuccinic amide), poly(N-vinylurea), poly(N-vinylpiperidone), poly(N-vinylcaprolactam), poly(N-vinyloxazoline) and the like, and single or several nonionic polymers may be added. According to an aspect of the invention, poly (N-vinyl-2-pyrrolidone) is desirably contained since dispersibility of carbon black is enhanced.

In a polyamic acid composition, the content of a nonionic polymer is desirably 0.2 parts by weight or more and 3 parts by weight or less based on 100 parts by weight of a polyamic acid.

Here, one example of the method of forming a polyimide resin layer using a polyamic acid composition as a precursor of the above-mentioned polyimide resin will be illustrated in detail below.

First, for example, the above-mentioned polyamic acid composition is prepared as described below. First, a polyamic acid solution, which is a precursor of a polyimide resin, obtained by polymerizing a tetracarboxylic dianhydride and a diamine component in an organic solvent is added into a poor solvent such as methanol to cause deposition of a polyamic acid which is purified by reprecipitation. The deposited polyamic acid is filtrated, and then, re-dissolved into a solvent such as γ-butyrolactone, to obtain a polyamic acid solution.

To the polyamic acid solution, a predetermined amount of tertiary amine and, if necessary, carboxylic anhydride, are added and the mixture is stirred for dissolution thereof, obtaining a polyamic acid composition.

Next, this solution is allowed to contain a conductive agent such as carbon black in a proportion of 5 parts by weight or more and 60 parts by weight or less in total based on 100 parts by weight in terms of dry weight of a polyamic acid resin.

Here, examples of the method of dispersing this conductive agent and crushing its agglomerate include, but not limited to, physical means such as stirring by a mixer and stirrer, parallel roll, ultrasonic dispersion, and chemical means such as introduction of a dispersing agent.

Next, this solution is applied on the inner surface or outer surface of a metal mold. As the metal mold, a cylindrical metal mold is preferable, and instead of the metal mold, molding dies made of various conventionally known materials such as resins, glass, ceramic may be preferably used as the molding die. Further, provision of a glass coat or ceramic coat on the surface of a molding die, and use of a silicone or fluorine-based releasing agent may also be selected. Further, a film thickness controlling metal mold having regulated clearance for a cylindrical metal mold is inserted in the cylindrical metal mold and moved in parallel to exclude an excess solution to eliminate irregularity in thickness of a solution on the cylindrical metal mold. If the thickness of a solution has been controlled in a stage of application of a solution on the cylindrical metal mold, there is particularly no need for use of the film thickness controlling metal mold.

Next, this cylindrical metal mold carrying thereon an applied polyamic acid solution is placed under a heating or vacuum atmosphere, and dried for volatilization of 30% by weight or more, desirably 50% by weight or more of the content solvent.

Further, this metal mold is heated at 200° C. or higher and 450° C. or lower, to progress an imide conversion reaction. The imidation temperature varies depending on the kinds of raw material tetracarboxylic dianhydride and diamine, however, should be set at temperatures realizing completion of imidation. When imidation is insufficient, a mechanical property and electric property are poor. If a case of imidation of a polyamic acid solution not imidated and a case of imidation of a polyamic acid solution partially imidated are compared, the partially imidated polyamic acid may be completely imidated at temperatures as low as about 50° C. or higher and 200° C. or lower, if the kinds of imides are identical, though varying depending on the partial imidation ratio and the like.

Thereafter, the resin is taken out from the metal mold, to obtain a polyimide resin film.

A hydrolysis treatment is performed on the outer circumference surface or the inner circumference surface (outer circumference surface in this exemplary embodiment) of the resulting polyimide resin film. Specifically, for example, contact with an alkali solution is performed. Further, the hydrolysis treatment may be carried out also by contact with water vapor.

As the alkaline solution (basic solution), aqueous solutions are mentioned prepared by dissolution into water of basic compounds such as hydroxides or carbonates of alkali metals (for example, lithium, sodium, potassium) and alkaline earth metals (magnesium, calcium). As the basic compound, sodium hydroxide and potassium hydroxide are suitable. The concentration of the basic compound in the alkaline solution is selected, for example, in the range of 0.1% by weight or more and 20% by weight or less.

The temperature of the hydrolysis treatment with an alkaline solution is, for example, in the range of 20° C. or higher and 100° C. or lower. As the hydrolysis treatment time, levels for obtaining an intended physical property are selected in the range of 10 seconds or more and 24 hours or less.

By this, the imidation ratio of the treated surface lowers, and, the alkali solution is impregnated from the treated surface and the imidation ratio increases continuously from the treated surface toward the thickness direction. In addition, the molecular structure of the tetracarboxylic acid residue and the diamine compound residue constituting the polyimide resin at the outer circumference surface and that at the inner circumference surface are mutually the same, and the composition ratio of the tetracarboxylic acid residue to the diamine compound residue constituting the polyimide resin at the outer circumference surface and that at the inner circumference surface are mutually the same. Thus, a belt of single layer constitution containing no clear boundary surface is obtained.

As the method of lowering the imidation ratio is not limited to the above-mentioned hydrolysis, and there is also a method in which at least one of amine catalysts and dehydration catalysts is allowed to contact to carry out the treatment. Examples of this amine catalyst include pyridine, picoline, quinoline, isoquinoline and the like. As the dehydration catalyst, phthalic anhydride, propionic acid, butanoic acid and the like are mentioned.

It is advantageous to allow an acidic solution to come into contact with the treated surface on which a hydrolysis treatment has been performed with an alkali solution. It is advantageous to wash the hydrolyzed surface with pure water to remove an alkali solution before treatment with an acidic solution. Additionally, solvents miscible with water such as alcohols may also be used together in addition to the above-described pure water.

On this treated surface on which a hydrolysis treatment has been performed with an alkali solution, a polyimide resin is hydrolyzed to form a metal salt of polyamic acid. Therefore, the polyamic acid metal salt is substituted by a polyamic acid using an acidic solution.

As the acidic solution, mineral acids such as hydrochloric acid, nitric acid, sulfuric acid are used. The concentration of the acidic solution is selected, for example, in the range of 0.1% by weight or more and 20% by weight or less.

The treatment with an acidic solution (amic oxidation treatment) is conducted, for example, at temperatures in the range of 20° C. or higher and 100° C. or lower. On the other hand, in the treatment with an acidic solution (amic oxidation treatment), for example, levels for obtaining an intended physical property are selected in the range of 10 seconds or more and 24 hours or less.

Thereafter, the surface of the polyimide resin film is washed with pure water, then, moisture is dried, and the resin is detached from the metal mold. Thus, an intended polyimide endless belt may be obtained. On the resultant polyimide endless belt, if necessary, slit processing of an edge, punching perforating processing, tape winding processing and the like are further performed in some cases.

Thus, the endless belt 50 according to this exemplary embodiment may be obtained.

The endless belt according to this exemplary embodiment described above may be used in various applications such as intermediate transfer belts and transfer delivery belts in image forming apparatuses of electrophotography mode such as electrophotography copying machines, laser beam printers, facsimiles and composite devices thereof.

In this exemplary embodiment, described is an exemplary embodiment in which the imidation ratio of a polyimide resin at the outer circumference surface is lowed than that at the inner circumference surface and the surface resistivity at the outer circumference surface is lower than that at the inner circumference surface, however, the exemplary embodiment is not limited to this, and an exemplary embodiment in which the imidation ratio of a polyimide resin at the outer circumference surface is higher than that at the inner circumference surface and the surface resistivity at the outer circumference surface is higher than that at the inner circumference surface is also permissible. This exemplary embodiment has, for example, a region in which the imidation ratio increases from the inner circumference surface side of the belt toward the outer circumference surface side in a range of 50% or less of the thickness, and a region in which the imidation ratio is constant from the above-mentioned region toward the outer circumference surface, thereafter, and for example, this exemplary embodiment may be realized by performing the above-mentioned hydrolysis treatment on the inner circumference surface of the belt.

In this exemplary embodiment, an exemplary embodiment of single layer constitution is explained, however, an exemplary embodiment may also be realized in which the outer circumference surface and the inner circumference surface of the endless belt 50 have mutually different surface resistivity together with mutually different imidation ratios of a polyimide resin due to a lamination constitution. This exemplary embodiment may be realized by, first, producing a polyimide endless belt base material, and forming a polyimide resin surface layer, whose imidation ratio and surface resistivity thereof are different from those of this polyimide endless belt base material, on the polyimide endless belt material.

In the description above, an exemplary embodiment containing a conductive agent in a belt is explained, however, the exemplary embodiment is not limited to this, and exemplary embodiments containing no conductive agent may also be permissible. Belts thus containing no conductive agent may be used in various applications such as delivery belts and fixing belts in image forming apparatuses of electrophotography mode such as electrophotography copying machines, laser beam printers, facsimiles and composite devices thereof.

Second Exemplary Embodiment

Figure 3:
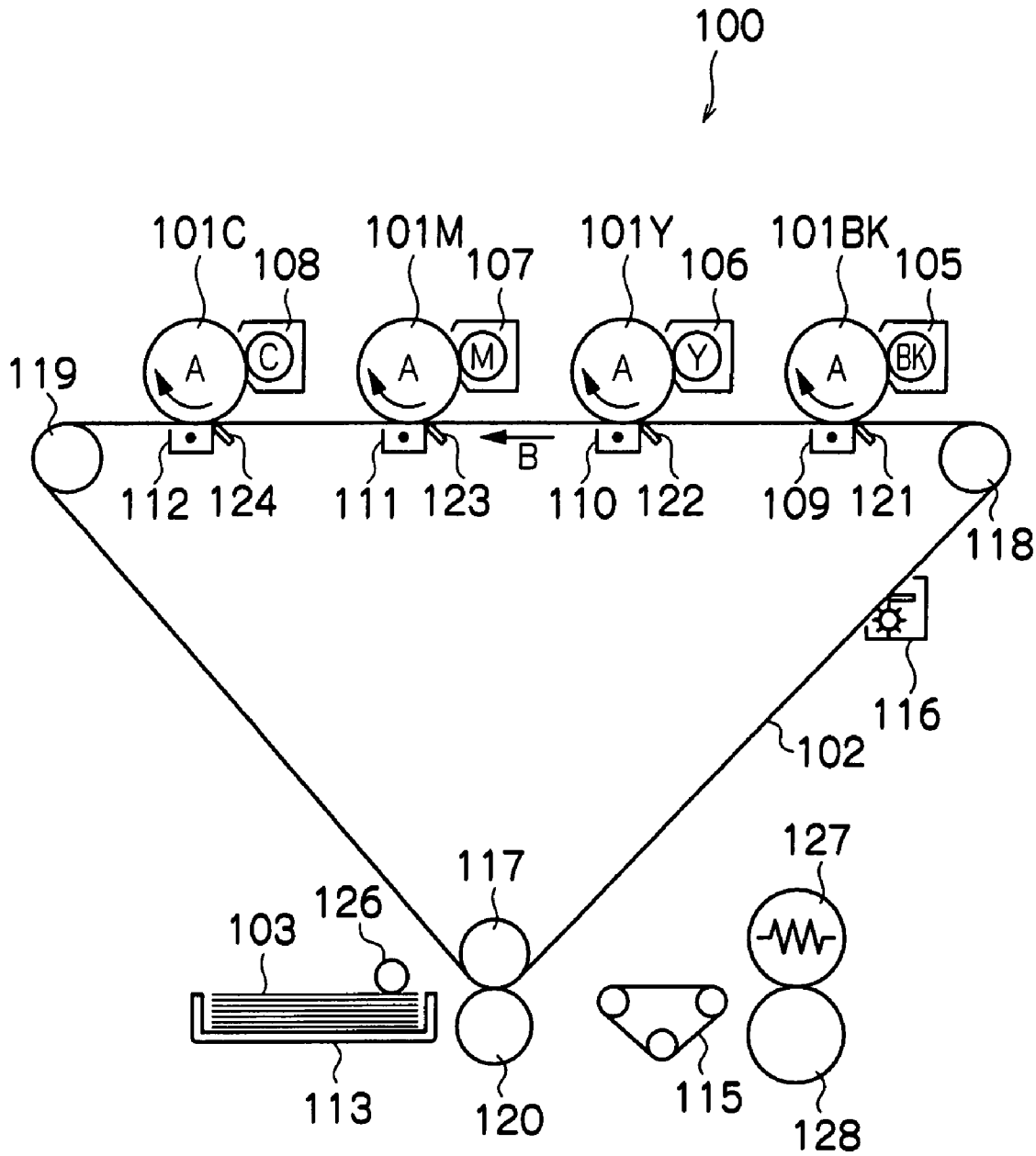
FIG. 3 is a schematic constitutional view showing an image forming apparatus according to a second exemplary embodiment.

FIG. 3 is a schematic constitutional view showing an image forming apparatus according to a second exemplary embodiment. The image forming apparatus according to the second exemplary embodiment is an embodiment in which an endless belt according to the first exemplary embodiment is applied as an intermediate transfer belt.

The image forming apparatus 100 according to the second exemplary embodiment has photoreceptor drums 101BK, 101Y, 101M and 101C as shown in FIG. 3, and in rotation along arrow A direction, electrostatic latent images corresponding to image information are formed on the surfaces of the drums by a known electrophotography process (not shown).

Around the photoreceptor drums 101BK, 101Y, 101M and 101C, developing devices 105 to 108 corresponding to colors of black (BK), yellow (Y), magenta (M) and cyan (C), respectively, are provided, and the electrostatic latent images formed on the photoreceptor drums 101BK, 101Y, 101M and 101C are developed by respective developing devices 105 to 108 to form toner images. Therefore, for example, an electrostatic latent image formed on the photoreceptor drum 101Y corresponds to yellow image information, and this electrostatic latent image is developed by the developing device 106 including yellow (Y) toner, and a yellow toner image is formed on the photoreceptor drum 101Y.

An intermediate transfer body 102 is an intermediate transfer belt in the form of belt so arranged as to get into contact with the surfaces of the photoreceptor drums 101BK, 101Y, 101M and 101C, and mounted under tension on several rolls 117 to 120 and rotates along an arrow B direction.

As the intermediate transfer body 102, a polyimide endless belt according to the first exemplary embodiment described already is applied.

Un-fixed toner images formed on the above-mentioned photoreceptor drums 101BK, 101Y, 101M and 101C are transferred onto the surface of the intermediate transfer body 102 sequentially from the photoreceptor drums 101BK, 101Y, 101M and 101C at respective primary transferring positions at which the photoreceptor drums 101BK, 101Y, 101M and 101C are in contact with the intermediate transfer body 102, so that respective colors overlap.

At the primary transferring positions, corona discharging devices 109 to 112 which prevent charging on contact regions before transfer by shielding members 121 to 124 for preventing action of transfer electric field on unnecessary regions of the intermediate transfer body 102 are mounted on the rear surface side of the intermediate transfer body 102, and by applying voltage having polarity opposite to charging polarity of the toner on the corona discharging device 109 to 112, the un-fixed toner images on the photoreceptor drums 101BK, 101Y, 101M and 101C are electrostatically attracted to the intermediate transfer body 102. As this primary transferring unit, not only corona discharging devices but also conductive rolls and conductive brushed applied with voltage may be used providing electrostatic force is utilized.

The un-fixed toner image thus primarily transferred to the intermediate transfer body 102 is transferred to a secondary transfer position facing a transfer route of a recording medium 103 by rotation of the intermediate transfer body 102. At the secondary transfer position, a secondary transferring roll 120 and a backface roll 117 in contact with the rear surface side of the intermediate transfer body 102 are placed sandwiching the intermediate transfer body 102.

The recording medium 103 delivered from a paper feeding part 113 at predetermined timing by a feeding roller 126 is inserted and passed through between the secondary transferring roll 120 and the intermediate transfer body 102. In this operation, voltage is applied between the above-mentioned secondary transferring roll 120 and roll 117, and the un-fixed toner image maintained on the intermediate transfer body 102 is transferred onto the recording medium 103 at the above-mentioned secondary transfer position.

The recording medium 103 carrying thereon the transferred un-fixed toner image is peeled from the intermediate transfer body 102, and fed by a delivery belt 115 into between a heating roll 127 and a pressing roll 128 of a fixing device having the heating roll 127 and pressing roll 128 provided in facing positions, and a fixation treatment of the un-fixed toner image is performed. In this case, an apparatus constitution having simultaneous transfer and fixation processes by which a secondary transfer process and a fixation process are conducted simultaneously is also possible.

For the intermediate transfer body 102, a belt cleaning apparatus 116 is provided. This cleaning apparatus 116 is placed so that it may get into contact with and disengage from the intermediate transfer body 102, and is spaced from the intermediate transfer body 102 until secondary transfer is performed.

The constitution of the image forming apparatus according to this exemplary embodiment is not limited to the above-mentioned exemplary embodiment, and example, image forming apparatuses having if necessary known units such as an image holding member, a charging units for charging the surface of an image holding member, an exposing units for exposing the surface of the image holding member to form an electrostatic latent image, a developing units for developing the latent image formed on the surface of the image holding member with a developer, to form a toner image, a transfer units for transferring the toner image on a transferring material, a fixing units for fixing the toner image on the transferring material, a cleaning units for removing the toner and trashes adhered to the image holding member, and a charge removing units for removing the electrostatic latent image remaining on the surface of the image holding member, are permissible.

In the image forming apparatus of this constitution, an endless belt according to the first exemplary embodiment may be applied according to the constitution of the image forming apparatus, as a belt to be used for a transferring units of secondary transfer mode utilizing an intermediate transfer belt, or as a belt to be used for a fixing units of belt mode utilizing a fixing belt.

Here, one example of apparatus constitutions is shown in which an endless belt of the first exemplary embodiment is applied to a fixing belt in a fixing units of belt mode.

For example, a constitution is mentioned using an image fixing apparatus having at least one or more driving members, an endless belt (fixing belt) which is driven-rotatable by the one or more driving members, and a pressing member in which the surface of any one driving member of the one or more driving members and the outer circumference surface of the endless belt form a press contact part by the pressing member which is placed in contact with the inner circumference surface of the endless belt and press the outer circumference surface of the endless belt toward the surface of the driving member, and an un-fixed toner image is fixed on the surface of the recording medium by passing the recording medium keeping thereon the un-fixed toner image through the press contact part while heating, wherein, an endless belt of the first exemplary embodiment is used as the endless belt.

The fixing means may have other constitutions and functions, if necessary, in addition to the above-described constitutions and functions, and for example, a lubricant may be applied on the inner circumference surface of an endless belt. As the lubricant, known lubricants in the form of liquid (for example, silicone oil and the like) may be used. The lubricant may be applied continuously via a felt and the like provided in contact with the inner circumference surface of an endless belt.

It is preferable that the fixing units may control pressure distribution along the axis direction of an endless belt at a press contact part, by the pressing member. For example, when a lubricant is used, the existing condition of the lubricant applied on the inner circumference surface may be arbitrarily controlled such as pushing the lubricant toward one edge of an endless belt and collecting the lubricant at the center part, by regulating the pressure distribution. As a result, it is possible, for example, that excess lubricant is collected to one edge of an endless belt and recovered, and that the lubricant is allowed to move to the center part of an endless belt, thereby preventing pollution in the apparatus due to leakage of the lubricant from the edge of an endless belt.

This control of pressure distribution is particularly useful when a lubricant is used, and further, when irregular roughness in the form of streak is imparted to the inner circumference surface of an endless belt to be used. In this case, control of the existing condition of the lubricant applied on the inner circumference surface becomes easier by regulating the pressure distribution at a press contact part in view of also the direction of a streak of the irregular roughness in the form of streak.

Third Exemplary Embodiment

Figure 4:
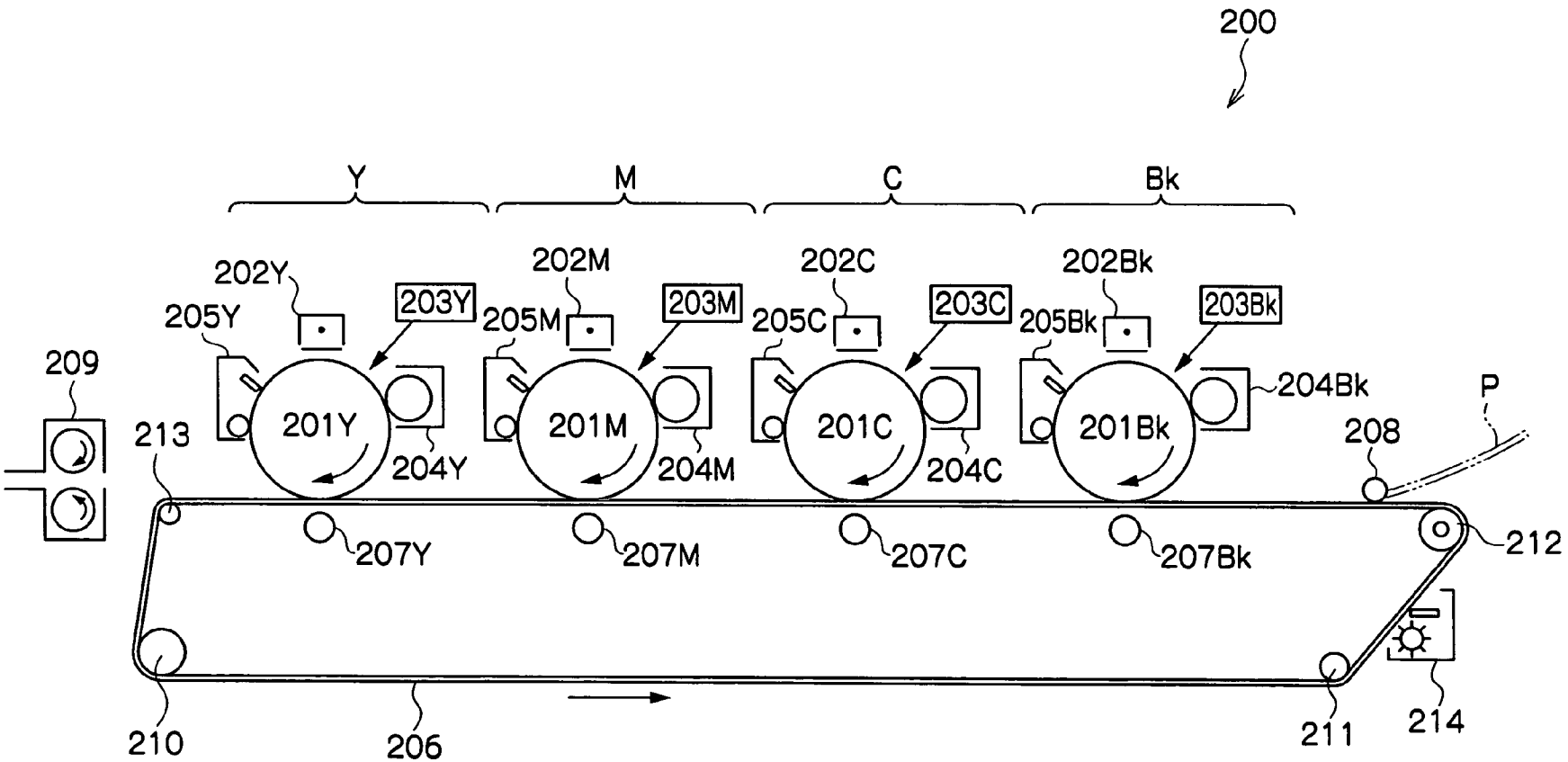
FIG. 4 is a schematic constitutional view showing an image forming apparatus according to a third exemplary embodiment.

FIG. 4 is a schematic constitutional view showing an image forming apparatus according to a third exemplary embodiment. The image forming apparatus according to the third exemplary embodiment is an embodiment in which an endless belt according to the first exemplary embodiment is applied as the transfer delivery belt.

The image forming apparatus 200 according to the third exemplary embodiment has units Y, M, C and Bk, a recording paper (transferring body) delivery belt (transfer delivery belt) 206, transferring rolls 207Y, 207M, 207C and 207Bk, a recording paper delivery roll 208, and a fixing units 209, as shown in FIG. 4. As this recording paper (transferring body) delivery belt 206, an endless belt according to the first exemplary embodiment is used.

In the units Y, M, C and Bk, photoreceptor drums 201Y, 201M, 201C and 201Bk as image holding members are provided in rotatable fashion with predetermined peripheral velocity along the arrow clockwise direction. Around the photoreceptor drums 201Y, 201M, 201C and 201Bk, placed are charging units 202Y, 202M, 202C and 202Bk, exposing units 203Y, 203M, 203C and 203Bk, developing units of respective colors (yellow developing unit 204Y, magenta developing unit 204M, cyan developing unit 204C, black developing unit 204Bk), and photoreceptor cleaners 205Y, 205M, 205C and 205Bk, respectively.

The units Y, M, C and Bk are placed in parallel against the recording paper delivery belt 206 in the order of units Y, M, C and Bk, however, proper orders may be set depending on the image formation method such as an order of units Bk, Y, C and M.

The recording paper delivery belt 206 is rotatable at the same peripheral velocity as the photoreceptor drums 201Y, 201M, 201C and 201Bk along arrowed counterclockwise direction by supporting rolls 210, 211, 212 and 213, and parts of the recording paper delivery belt 206 situated at intermediate positions between the supporting rolls 212 and 213 are placed so as to come into contact with the photoreceptor drums 201Y, 201M, 201C and 201Bk, respectively. The recording paper delivery belt 206 is provided with a belt cleaning apparatus 214.

Transferring rolls 207Y, 207M, 207C and 207Bk are placed at positions which are inside of the recording paper delivery belt 206 and face portions of contact between the recording paper delivery belt 206 and the transferring rolls 207Y, 207M, 207C and 207Bk, respectively. Transfer regions for transferring toner images to recording paper (transferring material) P via the recording paper delivery belt 206 are formed between the photoreceptor drums 201Y, 201M, 201C and 201Bk, and the transferring rolls 207Y, 207M, 207C and 207Bk.

A fixing device 209 is so placed that the recording paper P is delivered to the fixing device after passing through respective transferring regions between the recording paper delivery belt 206 and the photoreceptor drums 201Y, 201M, 201C and 201Bk.

The recording paper P is delivered to the recording paper delivery belt 206 by a recording paper delivery roll 208.

In the unit Y, the photoreceptor drum 201Y is driven to rotate. A charging unit 202Y is driven in conjunction with the photoreceptor drum 201Y, thereby charging the surface of the photoreceptor drum 201Y with predetermined polarity and potential. The photoreceptor drum 201Y having the charged surface is, then, exposed in image-like fashion by the exposing unit 203Y, to form an electrostatic latent image on its surface.

Subsequently, the electrostatic latent image is developed by the yellow developing unit 204Y. Then, a toner image is formed on the surface of the photoreceptor drum 201Y. The toner may be a one-component system or a two-component system, and in this exemplary embodiment, it is a two-component system.

The recording paper P is electrostatically adsorbed onto the recording paper delivery belt 206 and delivered to the transferring region, and the recording paper P passes through the transferring region formed between the photoreceptor drum 201Y and the transferring roll 207Y, and the toner image is transferred sequentially onto the outer circumference surface of the recording paper P by electric field formed by transfer bias applied from the transferring roll 207Y.

Thereafter, the toner remaining on the photoreceptor drum 201Y is cleaned and removed by the photoreceptor drum cleaner 205Y. The photoreceptor drum 201Y is subjected to the subsequent transferring cycle.

The above-described transferring cycle is conducted in the same manner also in the units M, C and Bk.

The recording paper P onto which toner images have been transferred by the transferring rolls 207Y, 207M, 207C and 207Bk is further delivered to the fixing device 209 and fixation is performed. By the above-described procedure, a desired image is formed on the recording paper.

In the third exemplary embodiment, an endless belt in the first exemplary embodiment is used as the transfer delivery belt and a delivering body such as recording paper is delivered, however, the exemplary embodiment is not limited to delivery of recording paper, and the endless belt may be applied to delivery also of delivering bodies other than recording paper, for example, media made of plastic (for example, OHP sheet and the like), cards, plates and the like.

In the description above, an exemplary embodiment of applying an endless belt according to the first exemplary embodiment to a belt member (intermediate transfer belt, transfer delivery belt and the like) for image forming apparatuses is mentioned. However, the exemplary embodiment is not limited to this, and for example, it is also possible to apply an endless belt according to the first exemplary embodiment to the belt in a transferring apparatus having the belt for delivering a delivering body such as, for example, a sheet.

All publications, patent applications, and technical standards mentioned in this specification are herein incorporated by reference to the same extent as if each individual publication, patent application, or technical standard was specifically and individually indicated to be incorporated by reference.

EXAMPLE

The invention will be illustrated by the following examples, however, the invention is not limited to these examples at all.

<Preparation of Polyamic Acid Solution>

In a flask equipped with a stirring rod, thermometer and dropping funnel, 1977.6 g of N-methyl-2-pyrrolidone (hereinafter, abbreviated as "NMP" in some cases) is poured while passing a nitrogen gas dried over phosphorus pentaoxide. The liquid temperature is raised up to 60° C., then, 200.2 g (1.0 mol) of 4,4'-diaminodiphenyl ether is added to cause dissolution. After confirmation of dissolution, 294.2 g (1.0 mol) of 3,3',4,4'-biphenyltetracarboxylic dianhydride is added while maintaining the solution temperature at 60° C., and the mixture is dissolved by stirring. After confirmation of dissolution of the tetracarboxylic dianhydride, stirring is further continued while maintaining at 60° C., to carry out a polymerization reaction of a polyamic acid. The reaction is performed for 24 hours, to obtain a polyamic acid solution (PAA-1) having a solid content of 20% by weight.

<Preparation of Carbon Black-Dispersed Polyamic Acid Solution (A-1)>

Into 500 g of the polyamic acid solution (PAA-1), 0.5 g of polyvinyl-2-pyrrolidone (manufactured by BASF Japan Ltd., Luvitec® K17: hereinafter, abbreviated as "PVP" in some cases) as a nonionic polymer is added to cause dissolution. 25.0 g of oxidation-treated carbon black (SPECIAL BLACK 4, manufactured by Degussa, pH 4.0, volatile content: 14.0%: hereinafter, abbreviated as "CB" in some cases) as a dried conductive agent is added, and the mixture is treated in a ball mill for 6 hours to cause dispersion of carbon black, to obtain a CB-dispersed polyamic acid composition (A-1). Its composition is shown below.

—Composition of CB-Dispersed Polyamic Acid Composition (A-1)—

Polyamic acid resin: 100 g
NMP: 400 g
PVP: 0.5 g
CB: 25.0 g

<Preparation of CB-Dispersed Polyamic Acid Solution (A-2)>

A CB-dispersed polyamic acid composition (A-2) is obtained in the same manner as for preparation of the CB-dispersed polyamic acid solution (A-1) excepting the CB amount is changed. Its composition is shown below.

—Composition of CB-Dispersed Polyamic Acid Composition (A-2)—

Polyamic acid resin: 100 g
NMP 400 g
PVP: 0.5 g
CB: 20.0 g

<Preparation of CB-Dispersed Polyamic Acid Solution (A-3)>

A CB-dispersed polyamic acid composition (A-3) is obtained in the same manner as for preparation of the CB-dispersed polyamic acid solution (A-1) excepting the CB amount is changed. Its composition is shown below.

—Composition of CB-Dispersed Polyamic Acid Composition (A-3)—

Polyamic acid resin: 100 g
NMP: 400 g
PVP: 0.5 g
CB: 30.0 g

Example 1

Production of Polyimide Endless Belt (C-1)

The above-mentioned CB-dispersed polyamic acid solution (A-1) is applied uniformly on the outer surface of a cylindrical SUS metal mold having an outer diameter of 90 mm and a length of 450 mm. A fluorine-based releasing agent is previously applied on the surface of this cylindrical metal mold, to improve releasability after belt formation.

Next, a drying treatment is conducted for 30 minutes at a temperature of 120° C. while the metal mold is rotated. After the drying treatment, a calcination treatment is conducted for about 30 minutes at a temperature of 300° C. in a clean oven, to progress an imidation reaction. Thereafter, the metal mold is allowed to cool at room temperature, and a resin is removed from the metal mold, to obtain an intended polyimide endless belt base material (B-1).

The resulting polyimide endless belt base material (B-1) is mounted on the outer surface of a cylindrical resin pipe having an outer diameter of 90 mm. For preventing invasion of treating liquid from the edge of the belt, the belt edge is pasted with a tape to the cylindrical resin pipe. The polyimide endless belt base material (B-1) and the cylindrical resin pipe are immersed in a sodium hydroxide aqueous solution (sodium hydroxide aqueous solution prepared by compounding 5 parts by weight of sodium hydroxide in 100 parts by weight of water) heated at 70° C. A hydrolysis treatment is performed for 30 minutes, then, the polyimide endless belt base material (B-1) and the cylindrical resin pipe are taken from the sodium hydroxide aqueous solution, and washed with pure water. Thereafter, the polyimide endless belt base material (B-1) and the cylindrical resin pipe are immersed in a hydrochloric acid aqueous solution (hydrochloric acid aqueous solution prepared by compounding 5 parts by weight of hydrogen chloride in 100 parts by weight of water) and treated at 25° C. for 30 minutes. They are taken out from the hydrochloric acid aqueous solution and washed with pure water. The belt is detached from the cylindrical resin pipe, then, dried for 30 minutes in a drying machine at 120° C. to obtain an intended polyimide endless belt (C-1).

<Evaluation>

The resulting polyimide endless belt (C-1) is subjected to the following evaluations. The results are shown in Table 1. Additionally, the molecular structures of a tetracarboxylic acid residue and a diamine compound residue constituting a polyimide resin at the outer circumference surface and the inner circumference surface and the composition ratio of the tetracarboxylic acid residue to the diamine compound residue are measured according to the above descriptions, to find that they are identical. Also for polyimide endless belts (C-2) to (C-6) described later, the same result is obtained.

(Measurement of Thickness)

For measurement of belt thickness, an eddy current mode thickness meter CTR-1500E manufactured by SANKO ELECTRONIC LABORATORY CO., LTD is used, and measurement is repeated 5 times for the same sample, and the average value thereof is used as belt thickness.

As a result, the thicknesses of the polyimide endless belt base material (B-1) before hydrolysis and the polyimide endless belt (C-1) after hydrolysis are 80±5 μm and 80±5 μm, respectively, that is the same value.

(Measurement of Bend Resistance)

From the resultant polyimide endless belt, ten test specimens of 150 mm×15 mm are prepared. The belt thickness is adjusted to 80 μm by variously controlling conditions in coating.

According to JIS-C5016, the number of reciprocating bending times until breakage of the test specimen is measured. The average value of the results of the ten test specimens is used as the evaluation result of bend resistance. As the measurement machine, a MIT knead fatigue resistance tester MIT-DA manufactured by Toyo Seiki Seisaku-Sho, Ltd. is used.

As a result, the evaluation result of bend resistance is 4500 times. The polyimide endless belt (C-1) after hydrolysis has sufficient strength and flexibility which may be used without problems for a belt application.

(Surface Resistivity)

On the resulting polyimide endless belt, a voltage of 100 V is applied under 22° C./55% RH environments using a cylindrical electrode (UR probe of HIRESTA IP manufactured by Mitsubishi Petrochemical Co., Ltd.: cylindrical electrode C has an outer diameter Φ of 16 mm, ring-shaped electrode part D has an inner diameter Φ of 30 mm and an outer diameter Φ of 40 mm), and the current value after 10 seconds is measured using R8340A manufactured by Advantest Corporation, and the surface resistivity (ρs) of belt outer surface/rear surface are calculated from the current value, and from this value, a common logarithm value (log(ρs) (log Ω)) of the surface resistivity is calculated.

Specifically, the surface resistivity may be measured according to JIS K6911 (1995) using the above-mentioned cylindrical electrode as an electrode for measurement.

Figure 5A:
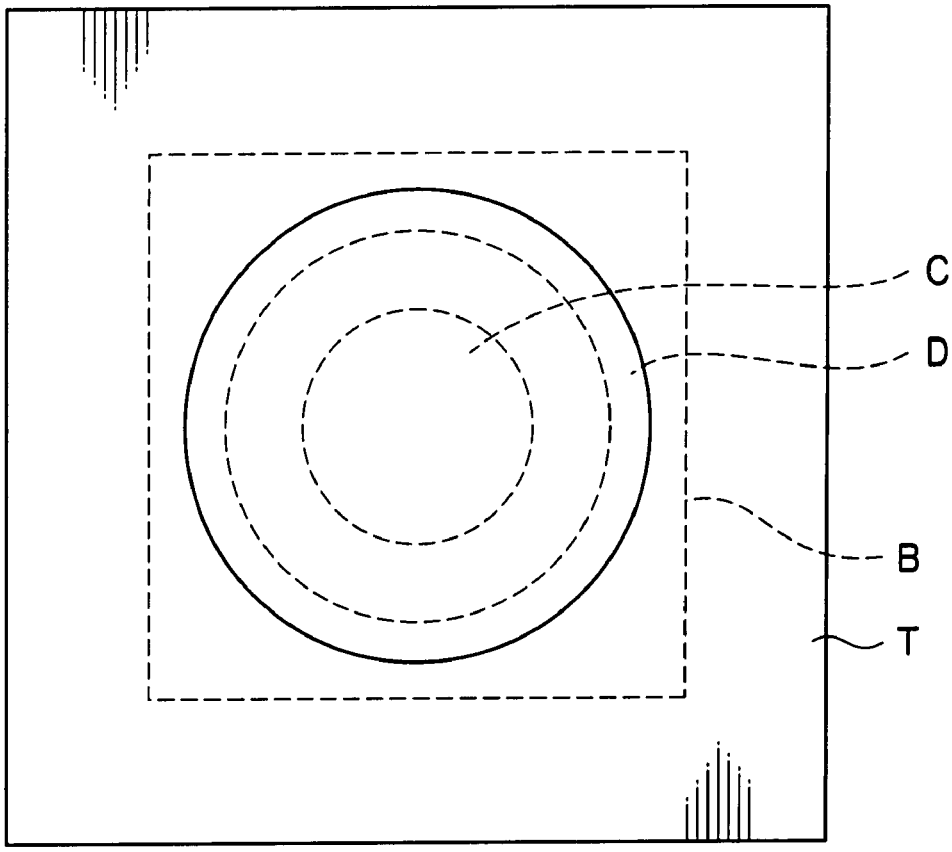
FIG. 5A is a schematic plan view showing one example of a circular electrode.
Figure 5B:
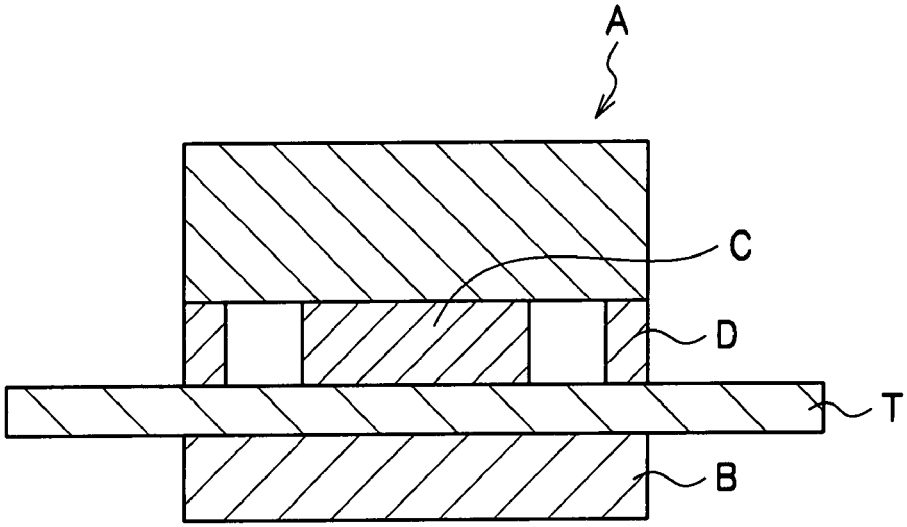
FIG. 5B is a schematic sectional view showing one example of a circular electrode.

The method for measuring surface resistivity is described using drawings. FIG. 5A is a schematic plan view of a cylindrical electrode and FIG. 5B is a schematic sectional view thereof. The cylindrical electrode shown in FIG. 5A and FIG. 5B has a first voltage application electrode A and a plate insulator B. The first voltage application electrode A has a cylindrical electrode part C and a cylindrical ring-shaped electrode D having an inner diameter larger than the outer diameter of the cylindrical electrode C and surrounding the cylindrical electrode part C with constant clearance. A belt T is sandwiched between the plate insulator B and the cylindrical electrode C and the ring-shaped electrode D of the first voltage application electrode A, and voltage V (V) is applied between the cylindrical electrode C and the ring-shaped electrode D of the first voltage application electrode A and current I (A) flowing in this operation is measured, and the surface resistivity ρs (Ω) of the belt T may be calculated by the following formula (1).

Here, in the following formula (1), d (mm) represents the outer diameter of the cylindrical electrode C and D (mm) represents the inner diameter of the ring-shaped electrode D, and π represents circular constant.

In measurement of surface resistivity, current I (A) is measured 10 seconds after application of voltage V (V).

$$\rho s=\pi\times(D+d)/(D-d)\times(V/I) \qquad \text{Formula (1)}$$

As a result, ρs of the outer circumference surface on which a hydrolysis treatment is applied of the polyimide endless belt (C-1) is lower than that of the un-treated surface.

(Imidation Ratio)

The imidation ratio of a polyimide endless belt is measured by infrared absorption spectrum measurement of a polyimide resin. As the measurement apparatus, microscope FT-IR FT-530 manufactured by Horiba Ltd. is used, and measurement is effected by reflected light spectrum of a belt sample.

In the case a polyimide resin composed of 3,3',4,4'-biphenyltetracarboxylic dianhydride as a tetracarboxylic anhydride and 4,4'-diaminodiphenyl ether as a diamine compound, the imidation ratio may be calculated by the formula (2) shown below using a ratio of the absorbance derived from a carbonyl group present in an imide group at 1780 $cm^{-1}$ (Abs1780) to the absorbance of a benzene ring at 1500 $cm^{-1}$ (Abs1500) as an internal standard, in the measured infrared absorption spectrum.

$$(\text{Imidation ratio})=(\text{Abs1780})/(\text{Abs1500})\times K\times 100 \qquad \text{Formula (2)}$$

Here, a polyamic acid (A-1) containing no CB is applied on a glass base plate, then, dried at 120° C. for 30 minutes, then, treated at 400° C. for 1 hour to complete an imidation reaction, and the ratio of the absorbance at 1780 $cm^{-1}$ (Abs1780) to the absorbance at 1500 $cm^{-1}$ of thus obtained polyimide film sample is represented by K in the formula (2) (K=Abs1780 (400° C. calcination)/Abs1500 (400° C. calcination)=0.27). Such K value corresponds to 100% imidated substance of the corresponding polyimide resin.

Also in a polyimide resin of different chemical composition, K value for the polyimide chemical composition is calculated by the absorbance derived from a benzene ring as an internal standard and the absorbance derived from an imide group, then, the imidation ratio under each belt production condition may be calculated in the same manner as in the previous example.

From the polyimide endless belt, a test specimen of 100 mm×100 mm is cut out, and the imidation ratios of both the outer circumference surface/inner circumference surface are measured. Thereafter, the outer surface of the polyimide endless belt is polished by No. 1000 sand paper. The thickness after polishing is measured, and the imidation ratio is measured again. By repeating this operation, profile of the imidation ratio along the belt depth direction is calculated. The measured values are shown in Table 1.

As a result, it is confirmed in the polyimide endless belt (C-1) that the imidation ratio at the outer circumference surface on which a hydrolysis treatment is performed and the imidation ratio on the non-treated surface (inner circumference surface) are different, and the imidation ratio changes (increases) continuously toward the depth direction (thickness direction) from the treated surface.

(Copy Image Quality)

The polyimide endless belt obtained as an intermediate transfer belt is mounted on remodeled DocuCentreColor2220 manufactured by Fuji Xerox Co., Ltd. (altered to, process speed: 250 mm/sec, primary transfer current: 33 μA), and 50% half tone of Cyan and Magenta is output at low temperature and low humidity (10° C., 15% RH) on 5000 pieces of C2 paper manufactured by Fuji Xerox Co., Ltd., and concentration irregularity and spot defect on the 5000-th image are visually evaluated based on the following standards. The evaluation standards are as described below.

—Concentration Irregularity—

A: no concentration irregularity is recognized.

B: slight concentration irregularity is recognized, however, no problematical level.

C: concentration irregularity is recognized, and somewhat problematical level.

D: concentration irregularity is clearly recognized, and practically problematical level.

—Spot Defect—

A: no spot defect is recognized.

B: slight spot defect is recognized, however, no problematical level.

C: spot defect is recognized, and somewhat problematical level.

D: spot defect is clearly recognized, and practically problematical level.

As a result, the polyimide endless belt (C-1) after hydrolysis shows that concentration irregularity is A level and spot defect is A level.

Example 2

Production of Polyimide Endless Belt (C-2)

A polyimide endless belt base material (B-2) is produced in the same manner as for the polyimide endless belt base material (B-1) excepting the CB-dispersed polyamic acid solution (A-1) is used and the calcination time is changed as shown in Table 1. A polyimide endless belt (C-2) is obtained in the same manner as for the polyimide endless belt (C-1) excepting the polyimide endless belt base material (B-2) is used, and evaluations are conducted in the same manner as in Example 1. The results are shown in Table 1.

Examples 3 to 4

Polyimide endless belts (C-3), (C-4) are obtained in the same manner as for the polyimide endless belt (C-1) excepting the polyimide endless belt base material (B-1) is used and the hydrolysis treatment times are changed as shown in Tables 1, 2, respectively, and evaluations are conducted in the same manner as in Example 1. The results are shown in Tables 1 to 2.

Examples 5 to 6

Polyimide endless belt base materials (B-3), (B-4) are produced in the same manner as for the polyimide endless belt base material (B-1) excepting the CB-dispersed polyamic acid solutions (A-2), (A-3) are used, respectively. Polyimide endless belts (C-5), (C-6) are obtained in the same manner as for the polyimide endless belt (C-1) excepting the polyimide endless belt base materials (B-3), (B-4) are used, and evaluations are conducted in the same manner as in Example 1. The results are shown in Table 2. For the polyimide endless belt (C-6), the hydrolysis treatment conditions are changed as shown in Table 2.

Examples 7 to 8

Production of Polyimide Endless Belts (C-7), (C-8)

Polyimide endless belts (C-7), (C-8) are obtained in the same manner as for the polyimide endless belt (C-1) excepting the polyimide endless belt base material (B-1) is used and the hydrolysis treatment conditions are changed as shown in Table 3, and evaluations are conducted in the same manner as in Example 1. The results are shown in Table 3.

Example 9

Production of Polyimide Endless Belt Base Material (B-8), Production of Laminated Polyimide Endless Belt (C-9): Laminated Belt A polyimide endless belt base material (B-8) is produced in the same manner as for the polyimide endless belt base material (B-1) excepting the above-mentioned CB-dispersed polyamic acid solution (A-1) is used and the thickness is 50 μm.

Further, the CB-dispersed polyamic acid composition (A-1) is coated on its surface as a surface layer having a thickness of 30 μm, and calcined under calcination conditions shown in Table 4, to produce a laminated polyimide endless belt (C-9).

The resulting polyimide endless belt base material (C-9) is subjected to the physical property evaluation in the same manner as in Example 1. The results are shown in Table 4.

Comparative Examples 1 to 3

Polyimide Endless Belt Base Materials (B-1), (B-3), (B-4): Single Layer Belt

The single layer polyimide endless belt base materials (B-1), (B-3), (B-4) are evaluated in the same manner as in Example 1. The results are shown in Table 5.

Comparative Example 4

Production of Polyimide Endless Belt Base Material (B-5), Production of Laminated Polyimide Endless Belt (Y-1): Laminated Belt A polyimide endless belt base material (B-5) is produced in the same manner as for the polyimide endless belt base material (B-1) excepting the above-mentioned CB-dispersed polyamic acid composition (A-1) is used and the thickness is 60 μm.

Further, the CB-dispersed polyamic acid composition (A-3) is coated on a surface of the polyimide endless belt base material (B-5) as a surface layer having a thickness of 20 μm, to produce a laminated polyimide endless belt (Y-1).

The resulting polyimide endless belt base material (B-5) and the polyimide endless belt (Y-1) are subjected to the physical property evaluation in the same manner as in Example 1. The results are shown in Table 6.

Comparative Example 5

A polyimide endless belt base material (B-6) is produced in the same manner as for the polyimide endless belt base material (B-1) excepting the above-mentioned CB-dispersed polyamic acid composition (A-2) is used and the thickness is 60 μm.

Further, the CB-dispersed polyamic acid composition (A-1) is coated on a surface of the polyimide endless belt base material (B-6) as a surface layer having a thickness of 20 μm, to produce a laminated polyimide endless belt (Y-2).

The resulting polyimide endless belt base material (B-6) and the polyimide endless belt (Y-2) are subjected to the physical property evaluation in the same manner as in Example 1. The results are shown in Table 6.

Comparative Example 6

The CB-dispersed polyamic acid composition (A-3) is coated on the surface of the above-mentioned polyimide endless belt base material (B-6) as a surface layer having a thickness of 20 μm, to produce a laminated polyimide endless belt (Y-3).

The resulting polyimide endless belt (Y-3) is subjected to the physical property evaluation in the same manner as in Example 1. The results are shown in Table 6.

Comparative Example 7

Production of Polyimide Endless Belt Base Material (B-7)

A cylindrical SUS metal mold having an internal diameter of 90 mm and a length of 450 mm and having an inner surface treated with a releasing agent is prepared, and the CB-dispersed polyamic acid composition (A-1) obtained in Example 1 is applied on the inner surface uniformly.

Next, the metal mold is rotated for 30 minutes at a speed of 100 rpm at room temperature to allow carbon black in the coated film to unevenly distribute on the surface (outer surface) by centrifugal force. Thereafter, a drying treatment is conducted for 30 minutes at a temperature of 120° C. while the metal mold is rotated. After the drying treatment, a calcination treatment is conducted for about 30 minutes at a temperature of 300° C. in a clean oven, to progress an imidation reaction. Thereafter, the metal mold is allowed to cool at room temperature, and a resin is removed from the metal mold, to obtain an intended polyimide endless belt base material (B-7).

The resulting polyimide endless belt base material (B-7) is subjected to the physical property evaluation in the same manner as in Example 1. The results are shown in Table 6.

TABLE 1

| | | | Examples and comparative examples | | |
|---|---|---|---|---|---|
| | | | Example 1 | Example 2 | Example 3 |
| CB dispersed polyamic acid composition | | | A-1 | A-1 | A-1 |
| Drying temperature | | | 120° C. | 120° C. | 120° C. |
| Drying time | | | 30 minutes | 30 minutes | 30 minutes |
| Calcination temperature | | | 300° C. | 350° C. | 300° C. |
| Calcination time | | | 30 minutes | 30 minutes | 30 minutes |
| Polyimide endless | Code | | B-1 | B-2 | B-1 |
| belt base material | Film thickness | | 80 ± 5 μm | 75 ± 5 μm | 80 ± 5 μm |
| property | Bend resistance | | 4500 times | 4500 times | 4500 times |
| | Surface resistivity | Outer surface/100 V | 11.0 | 12.5 | 11.0 |
| | | Inner surface/100 V | 11.0 | 12.5 | 11.0 |
| | Imidation ratio | Outer surface | 90% | 100% | 90% |
| | | Deep part (5 μm from outer surface) | 90% | 100% | 90% |
| | | Deep part (10 μm from outer surface) | 90% | 100% | 90% |
| | | Deep part (15 μm from outer surface) | 90% | 100% | 90% |
| | | Deep part (20 μm from outer surface) | 90% | 100% | 90% |

TABLE 1-continued

| | | | Examples and comparative examples | | |
|---|---|---|---|---|---|
| | | | Example 1 | Example 2 | Example 3 |
| | | Deep part (25 μm from outer surface) | 90% | 100% | 90% |
| | | Deep part (30 μm from outer surface) | 90% | 100% | 90% |
| | | Deep part (35 μm from outer surface) | 90% | 100% | 90% |
| | | Deep part (40 μm from outer surface) | 90% | 100% | 90% |
| | | Deep part (45 μm from outer surface) | 90% | 100% | 90% |
| | | Deep part (50 μm from outer surface) | 90% | 100% | 90% |
| | | Deep part (55 μm from outer surface) | 90% | 100% | 90% |
| | | Deep part (60 μm from outer surface) | 90% | 100% | 90% |
| | | Deep part (65 μm from outer surface) | 90% | 100% | 90% |
| | | Deep part (70 μm from outer surface) | 90% | 100% | 90% |
| | | Deep part (75 μm from outer surface) | 90% | 100% | 90% |
| | | Inner surface | 90% | 100% | 90% |
| | Copy image quality | Concentration irregularity | C | B | C |
| | | Spot defect | C | B | C |
| Basic aqueous solution treatment | Kind of base | | sodium hydroxide | sodium hydroxide | sodium hydroxide |
| | Concentration | | 0.05 | 0.05 | 0.05 |
| | Treating temperature | | 70° C. | 70° C. | 40° C. |
| | Treating time | | 30 minutes | 30 minutes | 30 minutes |
| Acidic aqueous solution treatment | Kind of acid | | hydrochloric acid | hydrochloric acid | hydrochloric acid |
| | Concentration | | 0.05 | 0.05 | 0.05 |
| | Treating temperature | | 25° C. | 25° C. | 25° C. |
| | Treating time | | 30 minutes | 30 minutes | 30 minutes |
| Polyimide endless belt property | Code | | C-1 | C-2 | C-3 |
| | Film thickness | | 80 ± 5 μm | 80 ± 5 μm | 80 ± 5 μm |
| | Bend resistance | | 4500 times | 4500 times | 4500 times |
| | Surface resistivity log Ω | Outer surface/100 V | 9.0 | 10.0 | 10.0 |
| | | Inner surface/100 V | 11.0 | 12.5 | 11.0 |
| | Imidation ratio | Outer surface | 70% | 80% | 75% |
| | | Deep part (5 μm from outer surface) | 74% | 85% | 78% |
| | | Deep part (10 μm from outer surface) | 78% | 90% | 81% |
| | | Deep part (15 μm from outer surface) | 82% | 95% | 84% |
| | | Deep part (20 μm from outer surface) | 86% | 100% | 87% |
| | | Deep part (25 μm from outer surface) | 90% | 100% | 90% |
| | | Deep part (30 μm from outer surface) | 90% | 100% | 90% |
| | | Deep part (35 μm from outer surface) | 90% | 100% | 90% |
| | | Deep part (40 μm from outer surface) | 90% | 100% | 90% |
| | | Deep part (45 μm from outer surface) | 90% | 100% | 90% |
| | | Deep part (50 μm from outer surface) | 90% | 100% | 90% |
| | | Deep part (55 μm from outer surface) | 90% | 100% | 90% |
| | | Deep part (60 μm from outer surface) | 90% | 100% | 90% |
| | | Deep part (65 μm from outer surface) | 90% | 100% | 90% |
| | | Deep part (70 μm from outer surface) | 90% | 100% | 90% |
| | | Deep part (75 μm from outer surface) | 90% | 100% | 90% |
| | | Inner surface | 90% | 100% | 90% |
| | Copy image quality | Concentration irregularity | A | A | B |
| | | Spot defect | A | A | B |

TABLE 2

| | | | Examples and comparative examples | | |
|---|---|---|---|---|---|
| | | | Example 4 | Example 5 | Example 6 |
| CB dispersed polyamic acid composition | | | A-1 | A-2 | A-3 |
| Drying temperature | | | 120° C. | 120° C. | 120° C. |
| Drying time | | | 30 minutes | 30 minutes | 30 minutes |
| Calcination temperature | | | 300° C. | 300° C. | 300° C. |
| Calcination time | | | 30 minutes | 30 minutes | 30 minutes |
| Polyimide endless belt base material property | Code | | B-1 | B-3 | B-4 |
| | Film thickness | | 80 ± 5 μm | 80 ± 5 μm | 80 ± 5 μm |
| | Bend resistance | | 4500 times | 4500 times | 4500 times |
| | Surface resistivity | Outer surface/100 V | 11.0 | 13.0 | 10.0 |
| | | Inner surface/100 V | 11.0 | 13.0 | 10.0 |
| | Imidation ratio | Outer surface | 90% | 90% | 90% |
| | | Deep part (5 μm from outer surface) | 90% | 90% | 90% |
| | | Deep part (10 μm from outer surface) | 90% | 90% | 90% |
| | | Deep part (15 μm from outer surface) | 90% | 90% | 90% |
| | | Deep part (20 μm from outer surface) | 90% | 90% | 90% |
| | | Deep part (25 μm from outer surface) | 90% | 90% | 90% |
| | | Deep part (30 μm from outer surface) | 90% | 90% | 90% |
| | | Deep part (35 μm from outer surface) | 90% | 90% | 90% |
| | | Deep part (40 μm from outer surface) | 90% | 90% | 90% |
| | | Deep part (45 μm from outer surface) | 90% | 90% | 90% |
| | | Deep part (50 μm from outer surface) | 90% | 90% | 90% |
| | | Deep part (55 μm from outer surface) | 90% | 90% | 90% |
| | | Deep part (60 μm from outer surface) | 90% | 90% | 90% |
| | | Deep part (65 μm from outer surface) | 90% | 90% | 90% |
| | | Deep part (70 μm from outer surface) | 90% | 90% | 90% |
| | | Deep part (75 μm from outer surface) | 90% | 90% | 90% |
| | | Inner surface | 90% | 90% | 90% |
| | Copy image quality | Concentration irregularity | C | C | C |
| | | Spot defect | C | C | C |
| Basic aqueous solution treatment | Kind of base | | sodium hydroxide | sodium hydroxide | sodium hydroxide |
| | Concentration | | 0.05 | 0.05 | 0.05 |
| | Treating temperature | | 20° C. | 70° C. | 40° C. |
| | Treating time | | 30 minutes | 30 minutes | 30 minutes |
| Acidic aqueous solution treatment | Kind of acid | | hydrochloric acid | hydrochloric acid | hydrochloric acid |
| | Concentration | | 0.05 | 0.05 | 0.05 |
| | Treating temperature | | 25° C. | 25° C. | 25° C. |
| | Treating time | | 30 minutes | 30 minutes | 30 minutes |
| Polyimide endless belt property | Code | | C-4 | C-5 | C-6 |
| | Film thickness | | 80 ± 5 μm | 80 ± 5 μm | 80 ± 5 μm |
| | Bend resistance | | 4500 times | 4500 times | 4500 times |
| | Surface resistivity log Ω | Outer surface/100 V | 10.5 | 11.0 | 9.0 |
| | | Inner surface/100 V | 11.0 | 13.0 | 10.0 |
| | Imidation ratio | Outer surface | 85% | 70% | 75% |
| | | Deep part (5 μm from outer surface) | 87.5% | 74% | 78% |
| | | Deep part (10 μm from outer surface) | 90% | 78% | 81% |
| | | Deep part (15 μm from outer surface) | 90% | 82% | 84% |
| | | Deep part (20 μm from outer surface) | 90% | 86% | 87% |
| | | Deep part (25 μm from outer surface) | 90% | 90% | 90% |
| | | Deep part (30 μm from outer surface) | 90% | 90% | 90% |
| | | Deep part (35 μm from outer surface) | 90% | 90% | 90% |
| | | Deep part (40 μm from outer surface) | 90% | 90% | 90% |

TABLE 2-continued

| | | | Examples and comparative examples | | |
|---|---|---|---|---|---|
| | | | Example 4 | Example 5 | Example 6 |
| | | Deep part (45 μm from outer surface) | 90% | 90% | 90% |
| | | Deep part (50 μm from outer surface) | 90% | 90% | 90% |
| | | Deep part (55 μm from outer surface) | 90% | 90% | 90% |
| | | Deep part (60 μm from outer surface) | 90% | 90% | 90% |
| | | Deep part (65 μm from outer surface) | 90% | 90% | 90% |
| | | Deep part (70 μm from outer surface) | 90% | 90% | 90% |
| | | Deep part (75 μm from outer surface) | 90% | 90% | 90% |
| | | Inner surface | 90% | 90% | 90% |
| | Copy image quality | Concentration irregularity | B | B | B |
| | | Spot defect | B | B | B |

TABLE 3

| | | | Examples | |
|---|---|---|---|---|
| | | | Example 7 | Example 8 |
| CB dispersed polyamic acid composition | | | A-1 | A-1 |
| Drying temperature | | | 120° C. | 120° C. |
| Drying time | | | 30 minutes | 30 minutes |
| Calcination temperature | | | 300° C. | 300° C. |
| Calcination time | | | 30 minutes | 30 minutes |
| Polyimide | Code | | B-1 | B-1 |
| | Film thickness | | 80 ± 5 μm | 75 ± 5 μm |
| | Bend resistance | | 4500 times | 4500 times |
| | Surface resistivity | Outer surface/100 V | 11.0 | 11.0 |
| | | Inner surface/100 V | 11.0 | 11.0 |
| | Imidation ratio | Outer surface | 90% | 90% |
| | | Deep part (5 μm from outer surface) | 90% | 90% |
| | | Deep part (10 μm from outer surface) | 90% | 90% |
| | | Deep part (15 μm from outer surface) | 90% | 90% |
| | | Deep part (20 μm from outer surface) | 90% | 90% |
| | | Deep part (25 μm from outer surface) | 90% | 90% |
| | | Deep part (30 μm from outer surface) | 90% | 90% |
| | | Deep part (35 μm from outer surface) | 90% | 90% |
| | | Deep part (40 μm from outer surface) | 90% | 90% |
| | | Deep part (45 μm from outer surface) | 90% | 90% |
| | | Deep part (50 μm from outer surface) | 90% | 90% |
| | | Deep part (55 μm from outer surface) | 90% | 90% |
| | | Deep part (60 μm from outer surface) | 90% | 90% |
| | | Deep part (65 μm from outer surface) | 90% | 90% |
| | | Deep part (70 μm from outer surface) | 90% | 90% |
| | | Deep part (75 μm from outer surface) | 90% | 90% |
| | | Inner surface | 90% | 90% |
| | Copy image quality | Concentration irregularity | C | C |
| | | Spot defect | C | C |

TABLE 3-continued

| | | | Examples | |
|---|---|---|---|---|
| | | | Example 7 | Example 8 |
| Basic aqueous solution treatment | Kind of base | | sodium hydroxide | sodium hydroxide |
| | Concentration | | 0.005 | 0.10 |
| | Treating temperature | | 50° C. | 90° C. |
| | Treating time | | 30 minutes | 30 minutes |
| Acidic aqueous solution treatment | Kind of acid | | hydrochloric acid | hydrochloric acid |
| | Concentration | | 0.05 | 0.05 |
| | Treating temperature | | 25° C. | 25° C. |
| | Treating time | | 30 minutes | 30 minutes |
| Polyimide endless belt property | Code | | C-7 | C-8 |
| | Film thickness | | 80 ± 5 μm | 80 ± 5 μm |
| | Bend resistance | | 4500 times | 4500 times |
| | Surface resistivity | Outer surface/100 V | 9.0 | 9.0 |
| | log Ω | Inner surface/100 V | 11.0 | 11.0 |
| | Imidation ratio | Outer surface | 88% | 50% |
| | | Deep part (5 μm from outer surface) | 89% | 55% |
| | | Deep part (10 μm from outer surface) | 90% | 60% |
| | | Deep part (15 μm from outer surface) | 90% | 65% |
| | | Deep part (20 μm from outer surface) | 90% | 70% |
| | | Deep part (25 μm from outer surface) | 90% | 75% |
| | | Deep part (30 μm from outer surface) | 90% | 80% |
| | | Deep part (35 μm from outer surface) | 90% | 85% |
| | | Deep part (40 μm from outer surface) | 90% | 90% |
| | | Deep part (45 μm from outer surface) | 90% | 90% |
| | | Deep part (50 μm from outer surface) | 90% | 90% |
| | | Deep part (55 μm from outer surface) | 90% | 90% |
| | | Deep part (60 μm from outer surface) | 90% | 90% |
| | | Deep part (65 μm from outer surface) | 90% | 90% |
| | | Deep part (70 μm from outer surface) | 90% | 90% |
| | | Deep part (75 μm from outer surface) | 90% | 90% |
| | | Inner surface | 90% | 90% |
| | Copy image quality | Concentration irregularity | C | C |
| | | Spot defect | B | B |

TABLE 4

| | | | Example Example 9 |
|---|---|---|---|
| Base material layer formation | CB dispersed polyamic acid composition | | A-1 |
| | Drying temperature | | 120° C. |
| | Drying time | | 30 minutes |
| | Calcination temperature | | 300° C. |
| | Calcination time | | 30 minutes |
| Polyimide endless belt base material property | Code | | B-8 |
| | Film thickness | | 50 ± 2 μm |
| | Bend resistance | | 8000 times |
| | Surface resistivity | Outer surface/100 V | 11.0 |
| | | Inner surface/100 V | 11.0 |
| | Imidation ratio | Outer surface | 90% |
| | | Deep part (5 μm from outer surface) | 90% |
| | | Deep part (10 μm from outer surface) | 90% |
| | | Deep part (15 μm from outer surface) | 90% |
| | | Deep part (20 μm from outer | 90% |

TABLE 4-continued

| | | | Example Example 9 |
|---|---|---|---|
| | | surface) | |
| | | Deep part (25 μm from outer surface) | 90% |
| | | Deep part (30 μm from outer surface) | 90% |
| | | Deep part (35 μm from outer surface) | 90% |
| | | Deep part (40 μm from outer surface) | 90% |
| | | Deep part (45 μm from outer surface) | 90% |
| | | Deep part (50 μm from outer surface) | — |
| | | Deep part (55 μm from outer surface) | — |
| | | Deep part (60 μm from outer surface) | — |
| | | Deep part (65 μm from outer surface) | — |
| | | Deep part (70 μm from outer surface) | — |
| | | Deep part (75 μm from outer surface) | — |
| | | Inner surface | 90% |
| | Copy image quality | Concentration irregularity | C |
| | | Spot defect | C |
| Surface layer formation | CB dispersed polyamic acid composition | | A-1 |
| | Drying temperature | | 120° C. |
| | Drying time | | 30 minutes |
| | Calcination temperature | | 250° C. |
| | Calcination time | | 30 minutes |
| Polyimide endless belt property | Code | | C-9 |
| | Film thickness | | 80 ± 10 μm |
| | Bend resistance | | 500 times |
| | Surface resistivity | Outer surface/100 V | 9.0 |
| | | Inner surface/100 V | 11.0 |
| | Imidation ratio | Outer surface | 70% |
| | | Deep part (5 μm from outer surface) | 70% |
| | | Deep part (10 μm from outer surface) | 70% |
| | | Deep part (15 μm from outer surface) | 70% |
| | | Deep part (20 μm from outer surface) | 70% |
| | | Deep part (25 μm from outer surface) | 70% |
| | | Deep part (30 μm from outer surface) | 90% |
| | | Deep part (35 μm from outer surface) | 90% |
| | | Deep part (40 μm from outer surface) | 90% |
| | | Deep part (45 μm from outer surface) | 90% |
| | | Deep part (50 μm from outer surface) | 90% |
| | | Deep part (55 μm from outer surface) | 90% |
| | | Deep part (60 μm from outer surface) | 90% |
| | | Deep part (65 μm from outer surface) | 90% |
| | | Deep part (70 μm from outer surface) | 90% |
| | | Deep part (75 μm from outer surface) | 90% |
| | | Inner surface | 90% |
| | Copy image quality | Concentration irregularity | B |
| | | Spot defect | C |

TABLE 5

| | | | Comparative Examples | | |
|---|---|---|---|---|---|
| | | | Comparative Example 1 | Comparative Example 2 | Comparative Example 3 |
| Base material layer | CB dispersed polyamic acid composition | | A-1 | A-2 | A-3 |
| | Drying temperature | | 120° C. | 120° C. | 120° C. |
| | Drying time | | 30 minutes | 30 minutes | 30 minutes |
| | Calcination temperature | | 300° C. | 300° C. | 300° C. |
| | Calcination time | | 30 minutes | 30 minutes | 30 minutes |
| Polyimide endless belt base material property | Code | | B-1 | B-3 | B-4 |
| | Film thickness | | 80 ± 5 μm | 80 ± 5 μm | 80 ± 5 μm |
| | Bend resistance | | 4500 times | 4500 times | 4500 times |
| | Surface resistivity log Ω | Outer surface/100 V | 11.0 | 13.0 | 10.0 |
| | | Inner surface/100 V | 11.0 | 13.0 | 10.0 |
| | Imidation ratio | Outer surface | 90% | 90% | 90% |
| | | Deep part (5 μm from outer surface) | 90% | 90% | 90% |
| | | Deep part (10 μm from outer surface) | 90% | 90% | 90% |
| | | Deep part (15 μm from outer surface) | 90% | 90% | 90% |
| | | Deep part (20 μm from outer surface) | 90% | 90% | 90% |
| | | Deep part (25 μm from outer surface) | 90% | 90% | 90% |
| | | Deep part (30 μm from outer surface) | 90% | 90% | 90% |
| | | Deep part (35 μm from outer surface) | 90% | 90% | 90% |
| | | Deep part (40 μm from outer surface) | 90% | 90% | 90% |
| | | Deep part (45 μm from outer surface) | 90% | 90% | 90% |
| | | Deep part (50 μm from outer surface) | 90% | 90% | 90% |
| | | Deep part (55 μm from outer surface) | 90% | 90% | 90% |
| | | Deep part (60 μm from outer surface) | 90% | 90% | 90% |
| | | Deep part (65 μm from outer surface) | 90% | 90% | 90% |
| | | Deep part (70 μm from outer surface) | 90% | 90% | 90% |
| | | Deep part (75 μm from outer surface) | 90% | 90% | 90% |
| | | Inner surface | 90% | 90% | 90% |
| | Copy image quality | Concentration irregularity | C | C | C |
| | | Spot defect | C | C | C |
| Surface layer | CB dispersed polyamic acid composition | | — | — | — |
| | Drying temperature | | — | — | — |
| | Drying time | | — | — | — |
| | Calcination temperature | | — | — | — |
| | Calcination time | | — | — | — |
| Polyimide endless belt property | Code | | — | — | — |
| | Film thickness | | — | — | — |
| | Bend resistance | | — | — | — |
| | Surface resistivity log Ω | Outer surface/100 V | — | — | — |
| | | Inner surface/100 V | — | — | — |
| | Imidation ratio | Outer surface | — | — | — |
| | | Deep part (5 μm from outer surface) | — | — | — |
| | | Deep part (10 μm from outer surface) | — | — | — |
| | | Deep part (15 μm from outer surface) | — | — | — |
| | | Deep part (20 μm from outer surface) | — | — | — |
| | | Deep part (25 μm from outer surface) | — | — | — |
| | | Deep part (30 μm from outer surface) | — | — | — |
| | | Deep part (35 μm from outer surface) | — | — | — |
| | | Deep part (40 μm from outer surface) | — | — | — |
| | | Deep part (45 μm from outer surface) | — | — | — |

TABLE 5-continued

| | | | Comparative Examples | | |
|---|---|---|---|---|---|
| | | | Comparative Example 1 | Comparative Example 2 | Comparative Example 3 |
| | | Deep part (50 μm from outer surface) | — | — | — |
| | | Deep part (55 μm from outer surface) | — | — | — |
| | | Deep part (60 μm from outer surface) | — | — | — |
| | | Deep part (65 μm from outer surface) | — | — | — |
| | | Deep part (70 μm from outer surface) | — | — | — |
| | | Deep part (75 μm from outer surface) | — | — | — |
| | | Inner surface | — | — | — |
| | Copy image quality | Concentration irregularity | — | — | — |
| | | Spot defect | — | — | — |

TABLE 6

| | | | Comparative Examples | | | |
|---|---|---|---|---|---|---|
| | | | Comparative Example 4 | Comparative Example 5 | Comparative Example 6 | Comparative Example 7 |
| Base material layer | CB dispersed polyamic acid composition | | A-1 | A-2 | A-2 | A-1 |
| | Drying temperature | | 120° C. | 120° C. | 120° C. | 120° C. |
| | Drying time | | 30 minutes | 30 minutes | 30 minutes | 30 minutes |
| | Calcination temperature | | 300° C. | 300° C. | 300° C. | 300° C. |
| | Calcination time | | 30 minutes | 30 minutes | 30 minutes | 30 minutes |
| Polyimide endless belt base material property | Code | | B-5 | B-6 | B-6 | B-7 |
| | Film thickness | | 60 ± 5 μm | 60 ± 5 μm | 60 ± 5 μm | 80 ± 20 μm |
| | Bend resistance | | — | — | — | — |
| | Surface resistivity log Ω | Outer surface/100 V | 11.0 | 13.0 | 13.0 | 8-11 |
| | | Inner surface/100 V | 11.0 | 13.0 | 13.0 | 8-11 |
| | Imidation ratio | Outer surface | 90% | 90% | 90% | 90% |
| | | Deep part (5 μm from outer surface) | 90% | 90% | 90% | 90% |
| | | Deep part (10 μm from outer surface) | 90% | 90% | 90% | 90% |
| | | Deep part (15 μm from outer surface) | 90% | 90% | 90% | 90% |
| | | Deep part (20 μm from outer surface) | 90% | 90% | 90% | 90% |
| | | Deep part (25 μm from outer surface) | 90% | 90% | 90% | 90% |
| | | Deep part (30 μm from outer surface) | 90% | 90% | 90% | 90% |
| | | Deep part (35 μm from outer surface) | 90% | 90% | 90% | 90% |
| | | Deep part (40 μm from outer surface) | 90% | 90% | 90% | 90% |
| | | Deep part (45 μm from outer surface) | 90% | 90% | 90% | 90% |
| | | Deep part (50 μm from outer surface) | 90% | 90% | 90% | 90% |
| | | Deep part (55 μm from outer surface) | 90% | 90% | 90% | 90% |
| | | Deep part (60 μm from outer surface) | — | — | — | 90% |
| | | Deep part (65 μm from outer surface) | — | — | — | 90% |
| | | Deep part (70 μm from outer surface) | — | — | — | 90% |
| | | Deep part (75 μm from outer surface) | — | — | — | 90% |
| | | Inner surface | 90% | 90% | 90% | 90% |
| | Copy image quality | Concentration irregularity | — | — | — | D |
| | | Spot defect | — | — | — | D |

TABLE 6-continued

| | | | Comparative Examples | | | |
|---|---|---|---|---|---|---|
| | | | Comparative Example 4 | Comparative Example 5 | Comparative Example 6 | Comparative Example 7 |
| Surface layer | CB dispersed polyamic acid composition | | A-3 | A-1 | A-3 | — |
| | Drying temperature | | 120° C. | 120° C. | 120° C. | — |
| | Drying time | | 30 minutes | 30 minutes | 30 minutes | — |
| | Calcination temperature | | 300° C. | 300° C. | 300° C. | — |
| | Calcination time | | 30 minutes | 30 minutes | 30 minutes | — |
| Polyimide endless belt property | Code | | Y-1 | Y-2 | Y-3 | — |
| | Film thickness | | 80 ± 10 μm | 80 ± 10 μm | 80 ± 10 μm | — |
| | Bend resistance | | 2000 times | 2000 times | 2000 times | — |
| | Surface resistivity logΩ | Outer surface/100 V | 10.0 | 11.0 | 10.0 | — |
| | | Inner surface/100 V | 10.0 | 11.0 | 10.0 | — |
| | Imidation ratio | Outer surface | 90% | 90% | 90% | — |
| | | Deep part (5 μm from outer surface) | 90% | 90% | 90% | — |
| | | Deep part (10 μm from outer surface) | 90% | 90% | 90% | — |
| | | Deep part (15 μm from outer surface) | 90% | 90% | 90% | — |
| | | Deep part (20 μm from outer surface) | 90% | 90% | 90% | — |
| | | Deep part (25 μm from outer surface) | 90% | 90% | 90% | — |
| | | Deep part (30 μm from outer surface) | 90% | 90% | 90% | — |
| | | Deep part (35 μm from outer surface) | 90% | 90% | 90% | — |
| | | Deep part (40 μm from outer surface) | 90% | 90% | 90% | — |
| | | Deep part (45 μm from outer surface) | 90% | 90% | 90% | — |
| | | Deep part (50 μm from outer surface) | 90% | 90% | 90% | — |
| | | Deep part (55 μm from outer surface) | 90% | 90% | 90% | — |
| | | Deep part (60 μm from outer surface) | 90% | 90% | 90% | — |
| | | Deep part (65 μm from outer surface) | 90% | 90% | 90% | — |
| | | Deep part (70 μm from outer surface) | 90% | 90% | 90% | — |
| | | Deep part (75 μm from outer surface) | 90% | 90% | 90% | — |
| | | Inner surface | 90% | 90% | 90% | — |
| | Copy image quality | Concentration irregularity | C | C | C | — |
| | | Spot defect | C | C | C | — |

It is found from the above-mentioned results that the polyimide endless belt base materials (B-1), (B-3) and (B-4) composed of a single layer structure have the same imidation ratio along the belt depth direction, and show excellent thickness uniformity, bend resistance and dependence of surface resistivity on voltage, however, have a tendency of deterioration of copy image quality as compared with the polyimide endless belts (C-1) to (C-6).

The laminated polyimide endless belts (Y-1), (Y-2) and (Y-3) have a result that uniformity of coating of a surface layer is not obtained and thickness uniformity is poor. In the polyimide endless belts (Y-1), (Y-2) and (Y-3) having nonuniform thickness, parts of small thickness and laminated boundary surface parts make a breaking base point, and a tendency of decreasing bending times by MIT knead fatigue resistant tester MIT-DA is observed. When the laminated polyimide endless belts (Y-1), (Y-2) or (Y-3) is mounted on an electrophotography apparatus, charge generated by a release discharge phenomenon occurring between belt/paper in operation accumulates on a boundary face part, thus, a tendency is observed that both concentration irregularity and spot defect are poorer than those of the polyimide endless belts (C-1) to (C-6).

In the resultant polyimide endless belt base material (B-7), there is a tendency that, though the surface resistivity value on the outer circumference surface is smaller as compared on the inner circumference surface, in-plane uniformity is poor, since the amount of carbon black increases at the surface part. The surface part tends to be scratched in handling the belt, which comes out as a defect in mounting on an electrophotography apparatus.

It is found from the above-mentioned results that the polyimide endless belts (C-1) to (C-6) according to this example have a single layer structure obtained by hydrolyzing the outer circumference surface of a polyimide endless belt base material, show high strength as a belt, have predetermined resistivity as an intermediate transfer belt, and have both reduced concentration irregularity and reduced spot defect when mounted on an electrophotography apparatus.

Therefore, it is understood that, when the polyimide endless belt of this example is used as an intermediate transfer belt, charge generated by a release discharge phenomenon occurring between belt/paper in operation may be eliminated quickly. Thus, it is understood that deterioration of belt properties with the lapse of time generated by repetition of the release discharge phenomenon may be suppressed, and an excellent printing image quality is obtained. Further, it is understood that, by preventing accumulation of static charge on the belt surface, adhesion of dust and the like may be suppressed, thereby preventing printing troubles, and an excellent copy image quality including no defects may be manifested.

The foregoing description of the exemplary embodiments of the present invention has been provided for the purposes of illustration and description. It is not limited to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An intermediate transfer belt, comprising a conductive agent and a polyimide resin at specific combination ratio, wherein:

an imidation ratio of the polyimide resin at an outer circumferential surface is lower than that at an inner circumferential surface;

a surface resistivity at the outer circumferential surface is lower than that at the inner circumferential surface;

a molecular structure of a tetracarboxylic acid residue and a diamine compound residue constituting the polyimide resin at the outer circumferential surface and that at the inner circumference surface are the same, and a composition ratio of the tetracarboxylic acid residue to the diamine compound residue constituting the polyimide resin at the outer circumferential surface and that at the inner circumference surface are the same; and wherein the belt has a single layer structure.

2. The intermediate transfer belt of claim 1, wherein a difference between the imidation ratio of the polyimide resin at the outer circumferential surface and the imidation ratio of the polyimide resin at the inner circumferential surface is from 5% to 20%.

3. The intermediate transfer belt of claim 1, comprising a region in which the imidation ratio of the polyimide resin at the outer circumferential surface or the inner circumferential surface changes continuously from a belt surface in a belt thickness direction.

4. An image forming apparatus, comprising an intermediate transfer belt comprising a conductive agent and a polyimide resin at specific combination ratio, wherein:

an imidation ratio of the polyimide resin at an outer circumferential surface is lower than that at an inner circumferential surface;

a surface resistivity at the outer circumferential surface is lower than that at the inner circumferential surface;

a molecular structure of a tetracarboxylic acid residue and a diamine compound residue constituting the polyimide resin at the outer circumferential surface and that at the inner circumferential surface are the same, and a composition ratio of the tetracarboxylic acid residue to the diamine compound residue constituting the polyimide resin at the outer circumferential surface and that at the inner circumferential surface are mutually the same; and the belt has a single layer structure.

5. A method of producing an intermediate transfer belt, wherein the method obtains the intermediate transfer belt of claim 1, and the method comprises:

applying a polyimide precursor onto a metal mold to form a coating film;

drying the coating film, and then calcining the coating film to form a polyimide resin film; and performing a hydrolysis treatment on one surface of the polyimide resin film.

6. The method of producing the intermediate transfer belt of claim 5, wherein an alkaline solution is contacted with the one surface of the polyimide resin film in the hydrolysis treatment.

7. The method of producing the intermediate transfer belt of claim 6, further comprising contacting an acidic solution with the one surface on which the hydrolysis treatment has been performed after performing the hydrolysis treatment.

* * * * *